US006209328B1

(12) United States Patent
Kim et al.

(10) Patent No.: US 6,209,328 B1
(45) Date of Patent: Apr. 3, 2001

(54) OIL-FREE COMPRESSOR-INTEGRATED PULSE TUBE REFRIGERATOR

(75) Inventors: Seon Young Kim; Kee Yong Hong, both of Kwangmyung; Sung Tae Kim, Seoul, all of (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 09/359,315

(22) Filed: Jul. 23, 1999

(30) Foreign Application Priority Data

| | | |
|---|---|---|
| Jul. 23, 1998 | (KR) | 98-29673 |
| Aug. 4, 1998 | (KR) | 98-31718 |
| Aug. 27, 1998 | (KR) | 98-34992 |
| Aug. 27, 1998 | (KR) | 98-34993 |
| Aug. 27, 1998 | (KR) | 98-34994 |
| Sep. 22, 1998 | (KR) | 98-39312 |
| Sep. 24, 1998 | (KR) | 98-39802 |
| Oct. 12, 1998 | (KR) | 98-42585 |
| Jan. 9, 1999 | (KR) | 99-340 |

(51) Int. Cl.[7] ..... F25B 9/00

(52) U.S. Cl. ..... 62/6; 60/517; 310/13; 417/488

(58) Field of Search ..... 62/6, 467; 60/517; 310/13; 417/488

(56) References Cited

U.S. PATENT DOCUMENTS

| | | | | |
|---|---|---|---|---|
| 5,295,355 | * | 3/1994 | Zhou et al. | 62/6 |
| 5,813,234 | * | 9/1998 | Wighard | 62/6 |
| 5,901,556 | * | 5/1999 | Hofler | 62/6 |
| 5,904,046 | * | 5/1999 | Kawano | 62/6 |
| 6,079,960 | * | 7/2000 | Funatsu et al. | 417/488 |

* cited by examiner

*Primary Examiner*—Ronald Capossela
(74) *Attorney, Agent, or Firm*—Birch, Stewart, Kolasch & Birch, LLP

(57) ABSTRACT

A compressor integrated pulse tube refrigerator of an oil free type is disclosed. The refrigerator includes a driving unit including a sealed casing having a cylinder disposed at an upper center portion of the same and a working gas filled therein, a linear motor installed in the interior of the sealed casing for generating a driving force, a driving shaft which is engaged to a rotor of the linear motor and linearly reciprocates, a piston connected with the driving shaft and inserted in the cylinder and reciprocating together with the driving shaft for thereby pumping a working gas, and a plurality of elastic guide support members provided in the interior of the sealed casing; and a refrigerating unit, for thereby implementing a stable reciprocating movement between a cylinder and a piston in a state that an outer surface of the piston does not contact with an inner surface of the cylinder.

41 Claims, 25 Drawing Sheets

FIG. 33A
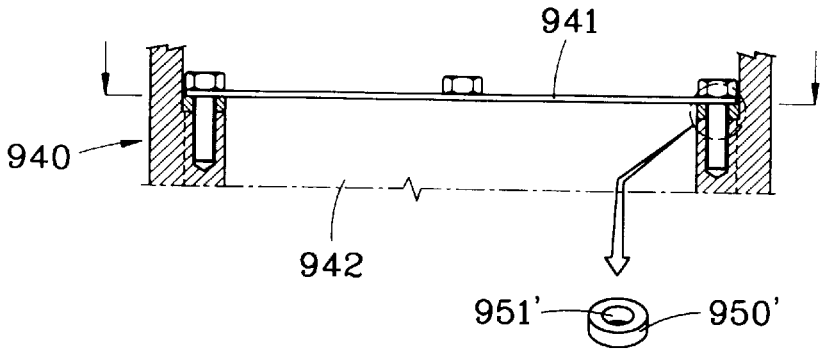
FIG. 33B
FIG. 33C
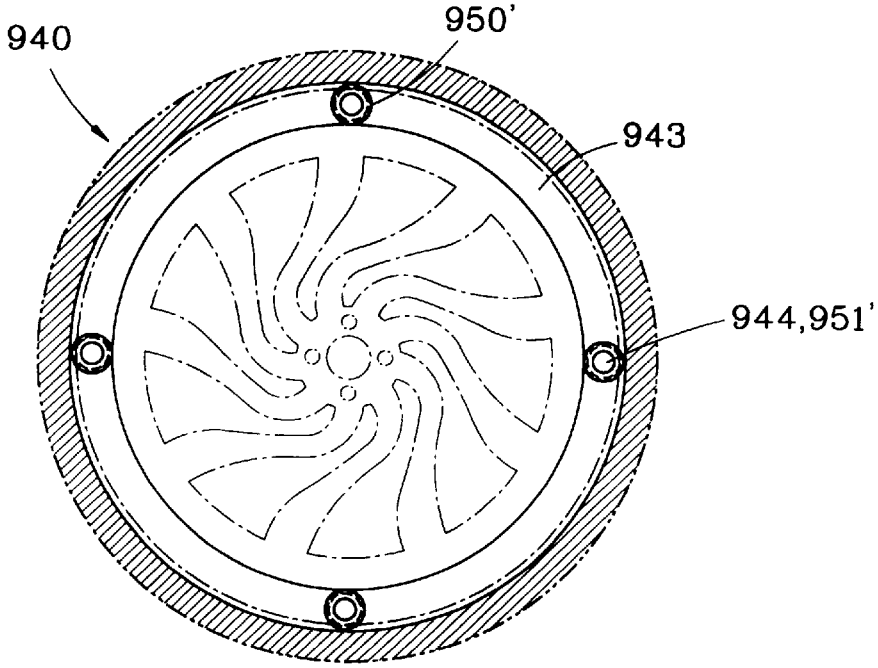

OIL-FREE COMPRESSOR-INTEGRATED PULSE TUBE REFRIGERATOR

BACKGROUND OF THE INVENTION

1. Field of the Invention

The present invention relates to a pulse tube refrigerator driven by an oil free type compressor, and in particular to a compressor integrated pulse tube refrigerator of an oil free type which is capable of maintaining an accurate gap between an inner surface of a cylinder and an outer surface of a piston so that a gas is not leaked through the gap to the outside in a state that the piston does not contact with an inner surface of the cylinder when the piston reciprocates within the cylinder.

2. Description of the Background Art

Generally, as a ultra low temperature refrigerator which is used for cooling a small size electronic component and a super-conductive material, a thermal reproducing type refrigerator such as a Stirling refrigerator, a GM refrigerator, etc. is used.

The resistance of most typical electronic components are decreased at a low temperature for thereby increasing an operational efficiency of the components, and the processing speed of a CPU(Central Processing Unit) used for a computer is increased.

In addition, as the super-conductive product is intensively studied, the need for a low temperature price ultra low refrigerator which is capable of satisfying the cooling conditions of the small size components is gradually increased.

In order to increase the reliability of the above-described refrigerator, the operation speed is decreased, or a lubricating operation is enhanced for preventing an abrasion between the friction portions during a pumping operation of a working gas, or the characteristic of a sealant is improved. In addition, the number of the operational portions is decreased.

Recently, as a ultra low temperature refrigerator which has a high reliable operation and is capable of implementing a high speed operation and does not need an additional lubricating operation and a maintenance for a long time, an oil free type compressor pulse tube refrigerator is disclosed.

The above-described oil free type compressor pulse tube refrigerator is directed to implementing a ultra low temperature refrigerating operation at an open side of the tube using a principle that when varying a pressure by periodically injecting a gas having a certain temperature into a one side-blocked tube, a large temperature variation is obtained at a portion in which there is a turbulent flow of the gas. Namely, the oil free type compressor pulse tube refrigerator is a refrigerator having a low average pressure and pressure ratio and a low refrigerating capacity. In the oil free type compressor pulse tube refrigerator, the pulse tube refrigerator includes one movement unit of a compressor compared to the conventional Stirling refrigerator having two movement units of a piston and displacer.

As a pulse tube refrigerator, there are a basic type pulse tube refrigerator, a resonance type pulse tube refrigerator having an acoustic driving unit, a hole type pulse tube refrigerator fabricated by installing an orifice, which generates a phase difference of a pressure pulse and a mas flow rate, and a storing container at the basic type pulse tube refrigerator, and an inertia tube type pulse tube refrigerator using an inertance tube(long neck tube) instead of the orifice. Among the above-described refrigerators, the basic type pulse tube refrigerator, the hole type pulse tube refrigerator and the inertia tube type pulse tube refrigerator will be explained.

First, as shown in FIG. 1, the basic type pulse tube refrigerator includes a driving unit M, a hollow pulse tube 1 having a warm end 1*a* and a cold end 1*b* for introducing a working gas pumped by the driving unit M for thereby compressing and expanding the gas therein, and a reproducing unit 2 connected between the driving unit M and the pulse tube 1 for maintaining a certain temperature of the working gas which contains a sensible heat due to a temperature difference based on the compressing and expanding operations of the working gas.

In the drawing, reference numerals 2*a* and 2*b* represent the connection tubes.

The operation of the basic type pulse tube refrigerator will be explained with reference to the accompanying drawings.

First, when the driving unit M pushes the working gas into the interior of the reproducing unit 2, the thusly pushed high temperature and pressure working gas having a sensible heat flows through the reproducing unit 2 and is flown into the pulse tube 1. The working gas in the pulse tube 1 is flown toward the blocked side and then is more compressed. At the warm end portion 1 a, a heat is radiated based on a heat transfer operation at the tube wall.

On the contrary, when the driving unit M sucks the working gas, the gas introduced into the interior of the pulse tube 1 is discharged, and the working gas in the pulse tube 1 is expanded, the heat is absorbed at the cold end 1*b* by a heat transfer at the tube wall. The above-described operation is repeatedly performed, so that it is possible to obtain a ultra low temperature(about −20° C.) at the cold end. At this time, the working gas discharged from the pulse tube 1 absorbs the heat stored in the reproducing unit 2 and is heated by a certain temperature and is introduced into the driving unit M.

The hole type pulse tube refrigerator will be explained with reference to the accompanying drawing.

First, as shown in FIG. 2, the hole type pulse refrigerator includes a driving unit M, a pulse tube 3 having a warm end portion 3*a* at which a gas is compressed and a cold end 3*b* at which a gas is expanded, as the working gas pumped by the driving unit M is inwardly introduced for thereby implementing a certain mass flow rate of the working gas, an orifice 4 connected with the warm end portion 3*a* of the pulse tube 3 for generating a certain phase difference based on the mass flow rate of the flowing working gas and the pressure pulse operation, a storing container 5 connected with the orifice 4 and holding the working gas therein for a certain time, and a reproducing unit 6 connected between the cold end 3*b* and the driving unit M for storing a sensible heat of the working gas pumped toward the pulse tube 3 and supplying the stored heat when the working gas flows from the pulse tube 3 to the driving unit M.

In the drawing, reference numerals 4*a*, 6*a* and 6*b* represent the connection tube.

The operation of the hole type pulse tube refrigerator is similar with the basic type pulse tube refrigerator except for the following difference. Namely, in the basic type pulse tube refrigerator, the heat is radiated from the working gas via the tube wall of the pulse tube 1. In the hole type pulse tube refrigerator, the working gas flows through the orifice 4 and increases the phase difference between the mass flow rate and the pressure pulse operation based on an adiabatic expansion for thereby obtaining a higher cooling capability.

Namely, in the hole type pulse tube refrigerator, when the working gas is supplied by the driving unit M and flows via the reproducing unit 6 and is introduced into the pulse tube 3, the working gas filled in the pulse tube 3 is adiabatically compressed, so that the temperature of the working gas is increased and is penetrated into the orifice 4, whereby the working gas is expanded by the orifice 4 and is filled in the storing container 5.

In addition, in the basic pulse tube refrigerator, the working gas is re-heated by receiving the heat from the tube wall, and in the hole type pulse refrigerator, the working gas is heated while the working gas flows the orifice 4 and is adiabatically compressed in the pulse tube 3.

When the working gas is sucked by the driving unit M, the working gas is adiabatically expanded due to a mass flow rate difference between the working gas flown from the pulse tube 3 and the working gas introduced into the pulse tube 3 via the orifice 4 when the working gas is flown from the pulse tube 3 to the reproducing unit 6, so that the temperature of the working gas is decreased.

The working gas in the pulse tube 3 is compressed by the working gas which is continuously introduced via the orifice 4, so that a ultra low temperature refrigerating effect of the pulse tube is obtained by the above-described processes.

In addition, in the inertia tube type pulse tube refrigerator which uses a lengthy tube having a small diameter instead of the orifice, it is possible to enhance the performance by increasing the variation of the phase difference between the mass flow rate and the pressure pulse operation.

The above-described pulse tube refrigerator and the inertia tube type pulse tube refrigerator generate a higher refrigerating capability based on the phase difference between the mass flow rate and the pressure pulse differently from the basic type refrigerator. The orifice and inertia tube are called as a phase controller(or a phase device or a phase developer). The hole type and inertia type pulse refrigerator (hereinafter called as a "Pulse tube refrigerator") will be explained.

As shown in FIG. 3, the conventional pulse tube refrigerator includes a driving unit 10 for generating a reciprocating flow of the working gas, a refrigerating unit 20 for having a ultra low temperature portion based on a thermal mechanics cycling operation of the working gas which reciprocates in the tube by the driving unit 10, and a valve selectively communicating the driving unit 10 and the refrigerating unit 20.

The structures of the driving unit 10 and the refrigerating unit 20 will be explained in detail.

The driving unit 10 includes a compressor 11 used for a common refrigerator using a lubricating oil, a low pressure container 12 installed at an inlet of the compressor 11 for storing a low pressure suction gas, a high pressure container 13 installed at an outlet of the compressor 11 for storing a high pressure exhausting gas, and an oil separating unit 14 installed between the high pressure container 13 and the outlet of the compressor 11 for removing an oil contained in the working gas and supplying the working gas to the compressor 11.

In the drawings, reference numerals 11*a*, 11*b*, 11*c*, 12*a*, 13*a*, and 14*a* represent the connection tubes.

The refrigerating unit 20 includes a pulse tube 21 having a compression portion 21*a* at which a compression is performed for thereby generating a heat and an expansion portion 21*b* at which an expansion is performed for thereby absorbing a heat as the working gas is mass-flown and a compression and expansion are performed at both ends of the same by the working gas pumped by the driving unit 10, an orifice 22 connected with the compression unit 21*a* of the pulse tube 21 for generating a phase difference between the mass flow rate of the working gas and the pressure pulse and implementing a thermal balance state, a storing container 23 connected with the orifice 22 for temporarily storing the working gas, a reproducing unit 24 connected between the expansion unit 21*b* of the pulse tube 21 and the driving unit 10 for compensating the temperature of the working gas returning from the pulse tube 21 to the driving unit, and a pre-cooling unit 25 connected between the reproducing unit 24 and the driving unit 10 for pre-cooling a high temperature and pressure working gas pumped from the driving unit 10.

The valve 30 is a rotary valve for repeatedly communicating the low pressure container 12 and the pre-cooling unit 25 or the high pressure container 13 and the pre-cooler 25 at a certain time interval and is installed between the low pressure container 12 and the high pressure container 13 of the driving unit 10 and the pre-cooling unit 25 of the refrigerating unit 20.

In the drawings, reference numeral 15 represents a driving unit casing, and 30*a* and 22*a* represent the connection tubes.

The operation of the conventional pulse tube refrigerator will be explained with reference to the accompanying drawings.

First, a low temperature and pressure working gas charged in the low pressure container 12 is compressed and changed to a high temperature and pressure working gas by the compressor 11 and passes trough the oil separating unit 14 and is stored in the high pressure container 13.

At this time, the oil separating unit 14 separates the oil contained in the working gas and outputs the separated oil to the compressor 11 and outputs the gas to the high pressure container 13.

First, the valve 30 communicates the high pressure container 13 and the refrigerating unit 20, and a high pressure working gas is cooled by the pre-cooling unit 25 and the reproducing unit 24 and is flown into the pulse tube 21. The working gas introduced into the pulse tube 21 pushes the working gas filled in the pulse tube 21 toward the orifice 22. At this time, the working gas filled in the pulse tube 21 is in a thermal balance state with respect to the tube wall and is moved toward the orifice 22, so that the working gas is adiabatically compressed, and the temperature of the same is increased.

As the valve 30 is closed, the pressure in the pulse tube 21 is maintained in a high pressure state, and the working gas in the pulse tube 21 is flown toward the lower pressure side storing container 23 via the orifice 22. During the above-described operation, the working gas is adiabatically expanded for thereby radiating the heat to the outside. The working gas in the pulse tube 21 becomes a thermal balance state at a temperature lower than at the initial state of the operation.

Thereafter, when the valve 30 communicates the low pressure container 13 and the refrigerating unit 10, the low temperature working gas filled in the pulse tube 21 is moved toward the low pressure container 12. The working gas moved toward the storing container 23 is moved again toward the pulse tube 21. At this time, the mass flow rate of the working gas which is flown from the pulse tube 21 via the reproducing unit 24 is greater than the mass flow rate of the working gas introduced into the pulse tube 21 via the orifice 22. Therefore, the working gas in the expansion unit 21*b* of the pulse tube 21 is rapidly adiabatically expanded, and the temperature of the same becomes a ultra low temperature.

Next, the valve 30 is closed. When the pressure in the pulse tube 321 is low, the working gas is flown into the pulse tube 21 from the storing container 23 to the orifice 22, so that the working gas in the pulse tube 21 is compressed, and the temperature of the same is increased up to the temperature before the driving operation. The above-described operation forms one cycle.

The working gas introduced into the low pressure container 12 via the reproducing unit 24 and the pre-cooling unit 25 is flown into the compressor 11 and is compressed therein. The thusly compressed working gas is filled into the high pressure container 13. When the valve 30 is opened, the working gas is flown again into the pulse tube 21. The above-described cycle is repeatedly performed. The temperature of the expansion unit 21*b* of the pulse tube 21 is decreased to about −200° C.

However, in the conventional pulse tube refrigerator, the structure of the refrigerator is simple. However, the driving unit includes a compressor, high/low pressure containers, an oil separating unit, etc. Therefore, the size of the system is too large. Since the elements such as the compressor, the high and low pressure container, the oil separating unit, etc. are independently assembled for forming one driving unit, the number of the assembling processes is increased, and the assembling time is extended.

In addition, due to a limitation with respect to the operation speed of the valve which selectively connects the driving unit and the refrigerating unit, it is impossible to properly supply a working gas to the refrigerating unit. The working gas which passes through the valve is adiabatically expanded, so that the efficiency of the refrigerator is decreased.

SUMMARY OF THE INVENTION

Accordingly, it is an object of the present invention to provide a compressor integrated pulse tube refrigerator of an oil free type which is capable of implementing a stable reciprocating movement between a cylinder and a piston in a state that an outer surface of the piston does not contact with an inner surface of the cylinder.

It is another object of the present invention to provide a compressor integrated pulse tube refrigerator of an oil free type which is capable of implementing an easier fabrication and assembly of a support member for a reciprocating movement of a piston.

It is another object of the present invention to provide a compressor integrated pulse tube refrigerator of an oil free type which makes it possible to increase a mass flow rate of a working gas and decrease a gas expansion loss before the gas is flown into the refrigerating unit by removing a valve disposed between a driving unit and a refrigerating unit and directly connecting the driving unit and the refrigerating unit for thus directly transferring a gas compression and expansion effect of a compressing unit to a refrigerating unit, so that it is possible to increase an efficiency of the refrigerator.

It is another object of the present invention to provide a compressor integrated pulse tube refrigerator of an oil free type which makes it possible to fabricate a compact product by integrally forming a compression unit and a refrigerating unit, decrease a fabrication cost and obtaining a high efficiency.

It is another object of the present invention to provide a compressor integrated pulse tube refrigerator of an oil free type which makes it possible to prevent a damage of the system by a fatigue generated as a support member repeatedly reciprocates for obtaining a resonance of a driving motor and enhancing a reliability of a refrigerator.

It is another object of the present invention to provide a compressor integrated pulse tube refrigerator of an oil free type which is capable of minimizing a contact area of a sealed casing and a plate spring.

To achieve the above objects, there is provided a compressor integrated pulse tube refrigerator of an oil free type according to a first embodiment of the present invention which comprises a driving unit including a sealed casing having a cylinder disposed at an upper center portion of the same and a working gas filled therein, a linear motor installed in the interior of the sealed casing for generating a driving force, a driving shaft which is engaged to a rotor of the linear motor and linearly reciprocates, a piston connected with the driving shaft and inserted in the cylinder and reciprocating together with the driving shaft for thereby pumping a working gas, and a plurality of elastic guide support members provided in the interior of the sealed casing; and a refrigerating unit.

To achieve the above objects, there is provided a compressor integrated tube refrigerator of an oil free type according to a second embodiment of the present invention which comprises a driving unit including a sealed casing having a cylinder therein at an upper center portion wherein a working gas is filled in the sealed casing, a linear motor installed in the interior of the sealed casing for generating a driving force, a piston inserted in the cylinder and having a head portion and a shaft portion having a diameter smaller than the head portion and moving together with the rotor engaged with a nut shape engaging member in a state that the shaft portion is engaged with the rotor of the linear motor, and a plurality of elastic guide support members engaged in the interior of the sealed casing for generating a resonant movement of the piston; and a refrigerating unit.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 33A is a front cross-sectional view illustrating another example of a plate spring mounting structure used for a compressor integrated pulse tube refrigerator of an oil free type according to the present invention;

FIG. 33B is an enlarged view of a ring; and

FIG. 33C is a plan cross-sectional view of FIG. 33A.

DETAILED DESCRIPTION OF THE PREFERRED EMBODIMENTS

The embodiments of the compressor integrated pulse tube refrigerator of an oil free type according to the present invention will be explained with reference to the accompanying drawings.

The compressor integrated pulse tube refrigerator of an oil free type according to each embodiment of the present invention is basically directed to pumping a working gas as a piston engaged to a rotor of a linear motor(hereinafter called as a driving motor) reciprocates within the interior of a cylinder without a friction between an outer surface of the piston and an inner surface of the cylinder without using an additional lubricating oil.

Figure 1:
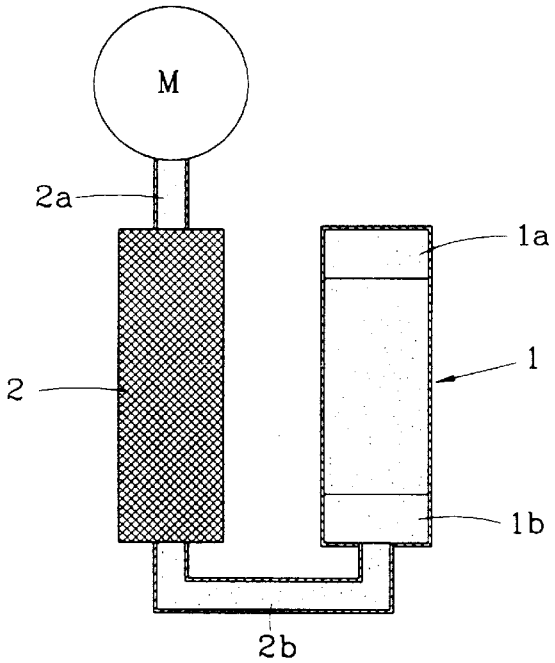
FIG. 1 CONVENTIONAL ART
FIG. 1 is a schematic view illustrating a conventional basic type pulse tube refrigerator.
Figure 2:
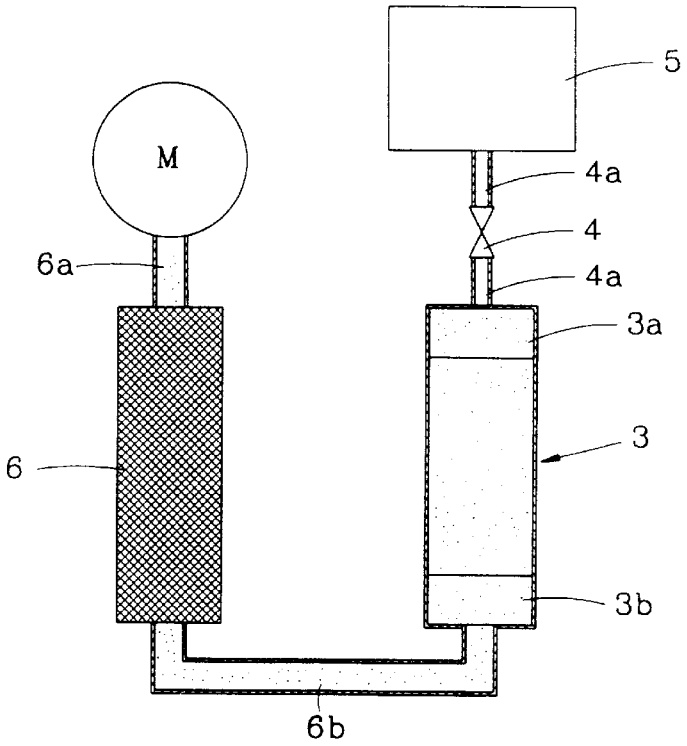
FIG. 2 CONVENTIONAL ART
FIG. 2 is a schematic view illustrating a conventional hole type pulse tube refrigerator.
Figure 3:
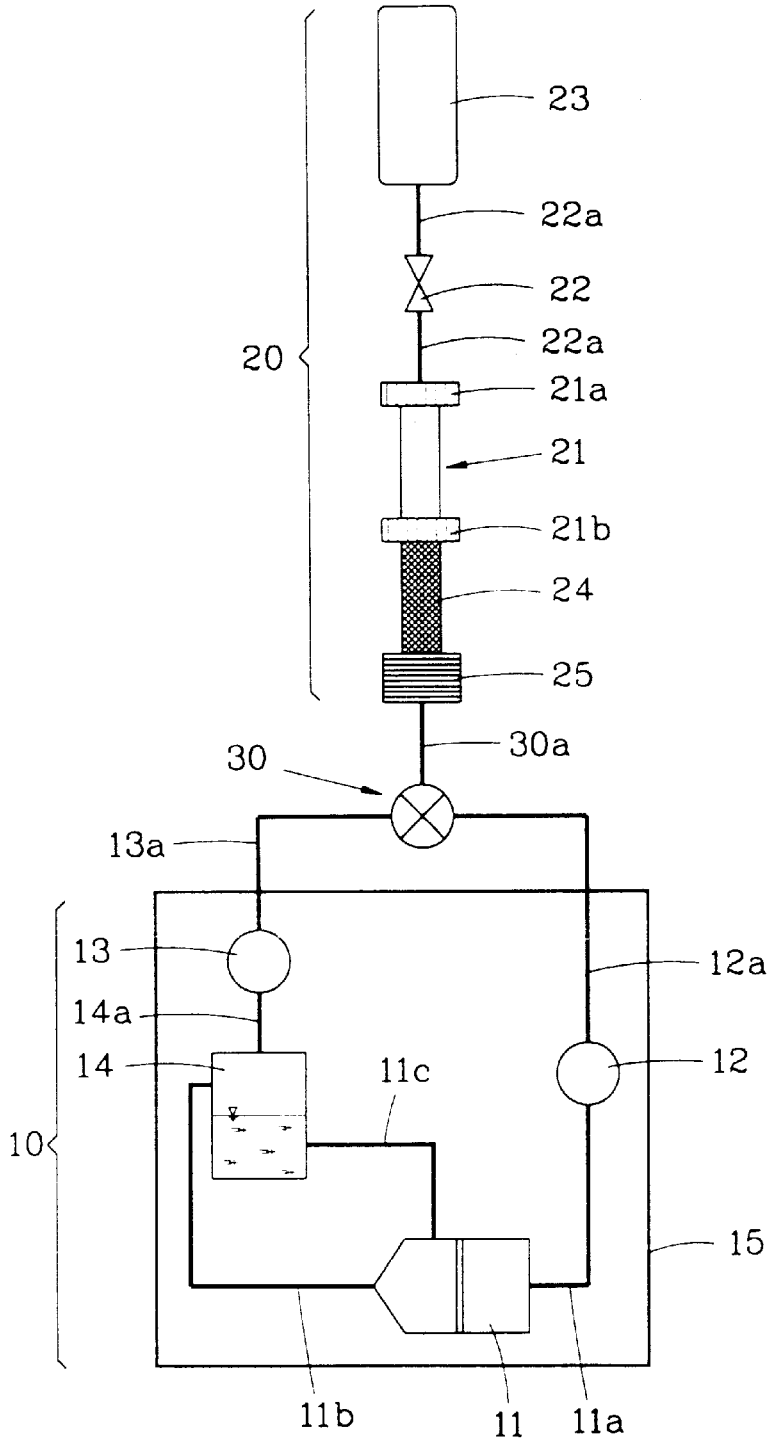
FIG. 3 CONVENTIONAL ART
FIG. 3 is a view illustrating a pipe mechanism for a conventional hole type pulse tube refrigerator.
Figure 4:
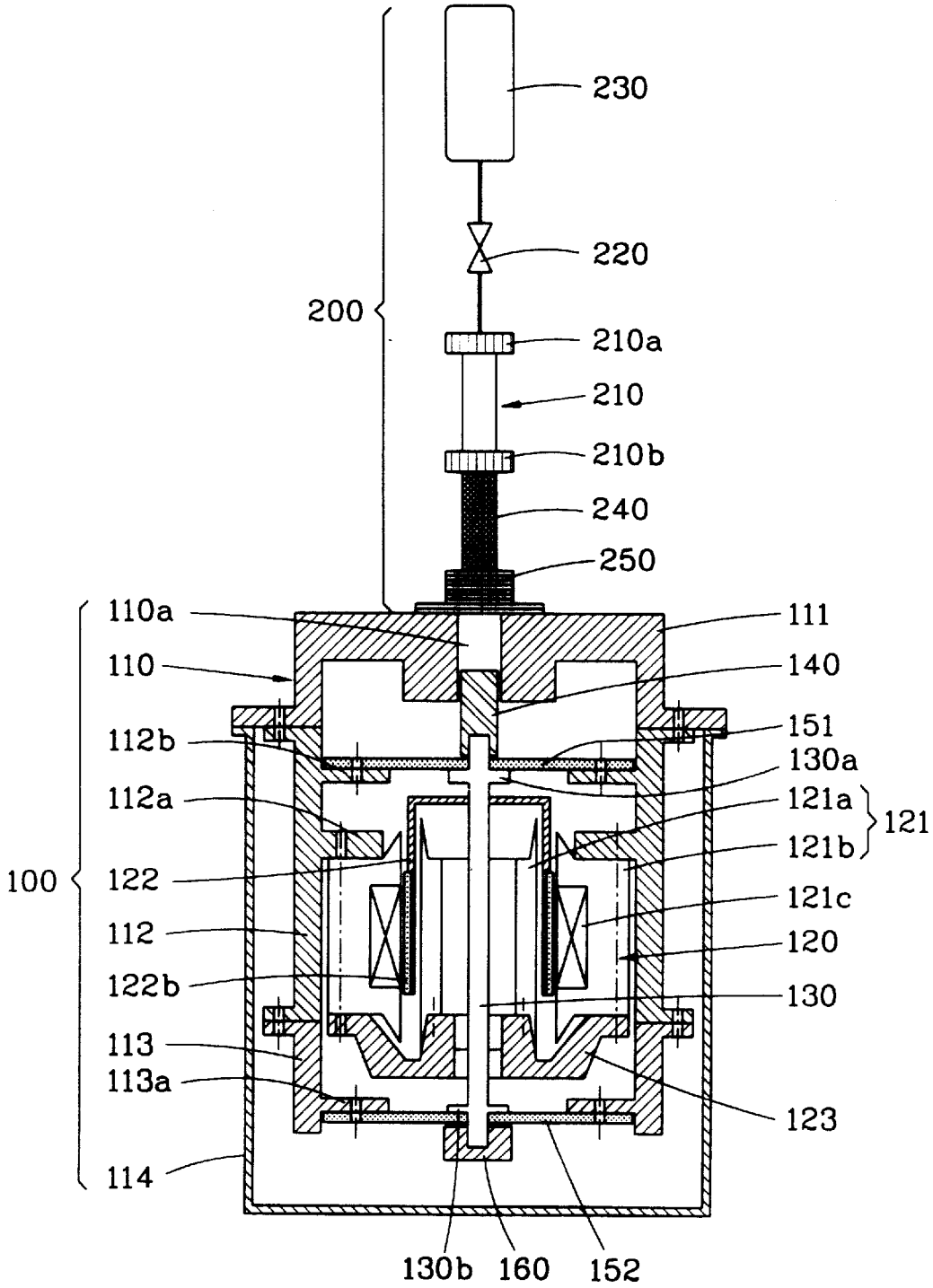
FIG. 4 is a vertical cross-sectional view illustrating the entire construction of a compressor integrated pulse tube refrigerator of an oil free type according to a first embodiment of the present invention.

As shown in FIG. 4, the compressor integrated pulse tube refrigerator according to a first embodiment of the present invention includes a driving unit 100 for generating a reciprocating movement of a working gas, and a refrigerating unit 200 having a ultra low temperature portion as the working gas pumped by the driving unit 100 reciprocates in the interior of the system.

The driving unit 100 includes a hollow cylindrical sealed casing 110 in which a cylinder 110*a* is formed at an upper center portion of the same, and a working gas is filled therein, a driving motor 120 disposed in the interior of the sealed casing 110 for generating a driving force, a driving shaft 130 engaged to the rotor 122 (described later) of the driving motor 120 and reciprocating together with the rotor, a piston 140 engaged to one end of the driving shaft 130 and inserted in the cylinder 110*a* for pumping the working gas as the same reciprocates together with the driving shaft 130, and a plurality of support members engaged to the driving shaft in the interior of the sealed casing 110 for receiving a reciprocating movement of the rotor 122 of the driving motor 120, storing the reciprocating movement as an elastic energy, converting the thusly stored elastic energy into a straight movement, generating a resonant movement of the piston 140, enabling the piston to repeatedly reciprocate, and guiding a reciprocating movement of the piston 140 which is moved by a reciprocating movement of the rotor 122 of the driving motor 120 at a certain space from the inner surface of the cylinder 110*a*.

The support members according to the first embodiment of the present invention are formed of circular plate springs which are formed in a spiral form and each includes a first elastic guide support member 151 and a second elastic guide support member 152 which operate in the axial direction for limiting a certain inclination in the radial direction.

The construction of the elements according to the first embodiment of the present invention will be explained.

The sealed casing 110 includes an upper frame 111 in which the cylinder 110*a* is formed so that the piston 140 reciprocates in the cylinder 110*a*, an intermediate frame 112 which is engaged with the lower surface of the upper frame 111 for thereby being concentrically formed with the upper frame 111 and has an inner surface engaged with an entire edge portion of the first elastic guide support member 151 engaged with the upper portion of the driving shaft 130 and in which the driving motor 120 is engaged, a lower frame 113 which is engaged with a lower surface of the intermediate frame 112 for thereby being concentrically formed with the intermediate frame 112 and is engaged with an entire edge portion of the second elastic guide support member 152 engaged with the lower portion of the driving shaft 130, and a sealed shell 114 surrounding the intermediate frame 112 and the lower frame 113 and having its upper end portion which is sealingly engaged with the lower surface of the upper frame 111 for thereby preventing the working gas from being leaked from the sealed casing 110.

The structure of the intermediate frame 112 will be explained in more detail.

In the intermediate frame 112, a circular shape motor support portion 112*a* is inwardly protruded for mounting the driving motor 120 at the intermediate portion of the inner surface, and a plurality of first elastic guide support member engaging portions 112*b* are inwardly protruded at the same height, on which the edge portions of the first elastic guide support member 151 is positioned and engaged at the upper portion of the motor support portion 112*a*.

At this time, the inner diameter of each of the first elastic guide support member engaging portions is smaller than the outer diameter of the driving motor for increasing the straight movement and the concentric degree which may be decreased when the diameter of the first elastic guide support member 151 is relatively great.

In the lower frame 113, a plurality of second elastic guide support member engaging portions 113*a* which are inwardly protruded for engaging the second elastic guide support member 152 at the inner surface are formed at the same height in the same shape as the first elastic guide support member engaging portion 112*b* of the intermediate frame 112.

The inner diameter of the second elastic guide support member engaging portion 113*a* is preferably smaller than the outer diameter of the driving motor 120 for the same reason as the first elastic guide support member engaging portion 112*b* formed at the intermediate frame 112.

Figure 6:
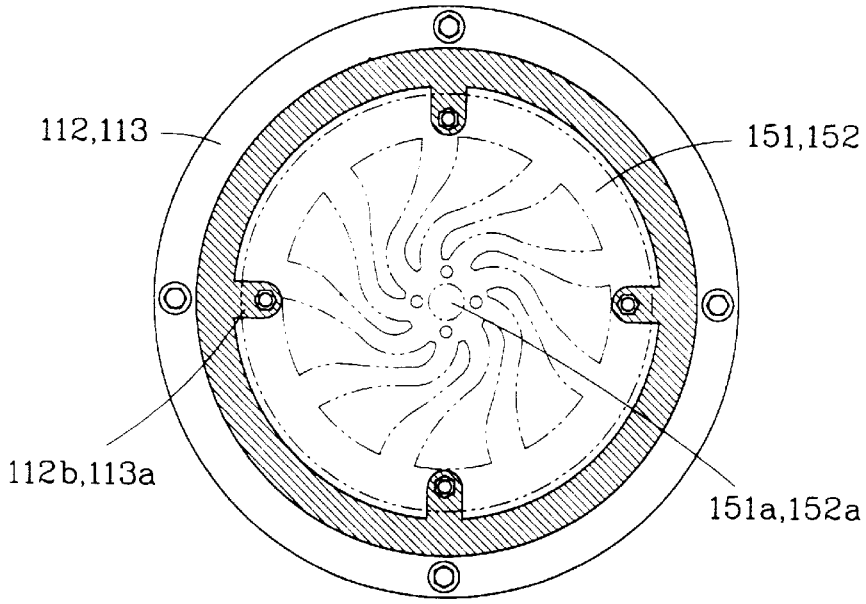
FIG. 6 is a cross-sectional view taken along line VI—VI of FIG. 5.

As shown in FIG. 6, driving shaft engaging holes 151*a* and 152*a* formed at the center portion of the first elastic guide support member 151 and the second elastic guide support member 152 are formed concentrically with the cylinder 110*a* of the upper frame 111 for maintaining a straight reciprocating movement of the piston 140*a*.

The structure of the driving motor 120 will be explained in detail.

The driving motor 120 includes a known linear motor which is formed of inner and outer laminations 121*a* and 121*b* formed of a plurality of stacked steel plates, a stator 121 formed of a plurality of coils 121*c* wound onto the outer lamination 121*b*, and a rotor 122 disposed between the inner and outer laminations 121*a* and 121*b* and engaged with the driving shaft 130 and having a magnet 122*b* formed opposite the coil 121*c*. The outer lamination 121*b* is engaged to the intermediate frame 112 in the interior of the sealed casing 110, and the inner lamination 121*a* is integrally engaged with the outer lamination 121*b* by an additional connection ring 123.

In addition, the driving shaft 130 passes through the upper center portion of the cylindrical rotor 122 having its opened lower surface and is integrally engaged with the rotator 122. The upper end of the driving shaft 130 passes through the center portion of the first elastic guide support member 151 and is integrally inserted into the piston 140. The lower end of the same passes through the center portion of the second elastic guide support member 152 and is fixedly inserted into the fixing member 160.

Here, in order to implement a resonance movement and straight movement of the driving shaft 130, the driving shaft 130, the first elastic guide support member 151, and the second elastic guide support member 152 are concentrically installed.

Figure 5:
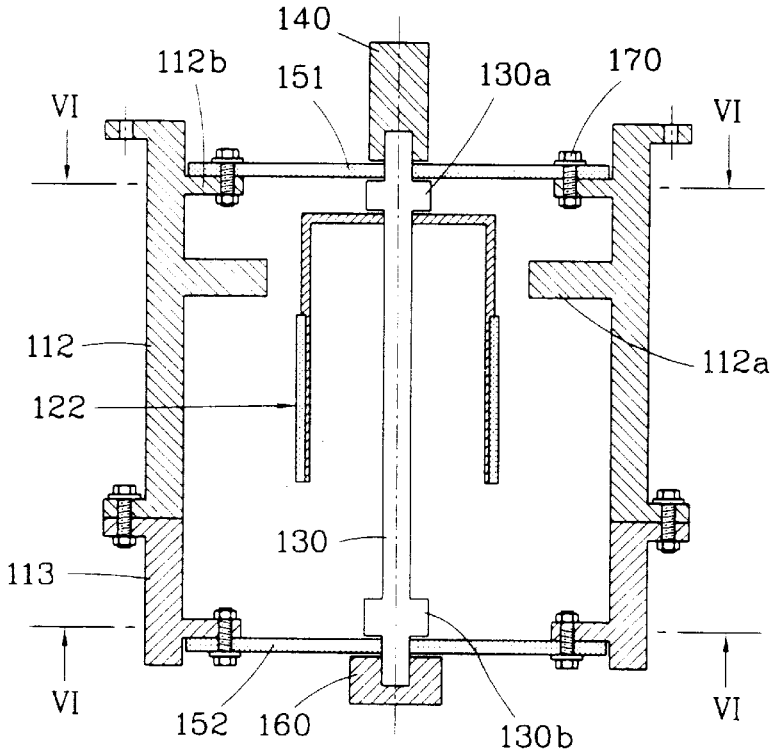
FIG. 5 is a vertical cross-sectional view illustrating a driving unit for a compressor integrated pulse tube refrigerator of an oil free type according to a first embodiment of the present invention.

As shown in FIG. 5, an upper support shoulder portion 130*a* is formed on the upper portion of the driving shaft 130 and contacts with the center portion of the lower surface of the first elastic guide support member 151 at a certain outer portion of the driving shaft 130 which is positioned at a lower portion of the piston 140. A lower support shoulder portion 130*b* is formed at a lower portion of the driving shaft 130 and contacts with the center portion of the upper surface of the second elastic guide support member 152 at a certain outer portion of the driving shaft 130 positioned at the upper portion of the fixing member 160.

As shown in FIG. 4, the refrigerating unit 200 includes a pulse tube 210 includes a pulse tube 210 having a compression portion 211 (warm portion) at which a compression is performed, and an expanding portion 212(cold end) at which an expansion is performed wherein the working gas in the refrigerating unit 200 is mass-flown by the working gas pumped by the cylinder 110*a* of the sealed casing 110 at above-described both ends for thereby externally absorbing the heat, an orifice 220 connected with the compression portion 211 of the pulse tube 210 for generating a phase difference between the mass flow rate of the flowing working gas and the pressure pulse for thereby implementing a thermal balance, a storing container 230 connected with the orifice 220 and having the working gas therein for a certain time, a reproducing unit 240 connected between the expansion unit 210*b* of the pulse tube 210 and the cylinder 110*a* of the cylinder 110*a* for storing a sensible heat of the working gas pumped to the pulse tube 210 and supplying the stored heat when the working gas is returned to the cylinder 110*a* of the driving unit 100 in the pulse tube 210, and a pre-cooling unit 250 connected between the reproducing unit 240 and the cylinder 110*a* of the driving unit 100 for pre-cooling the high temperature and pressure working gas.

Figure 7:
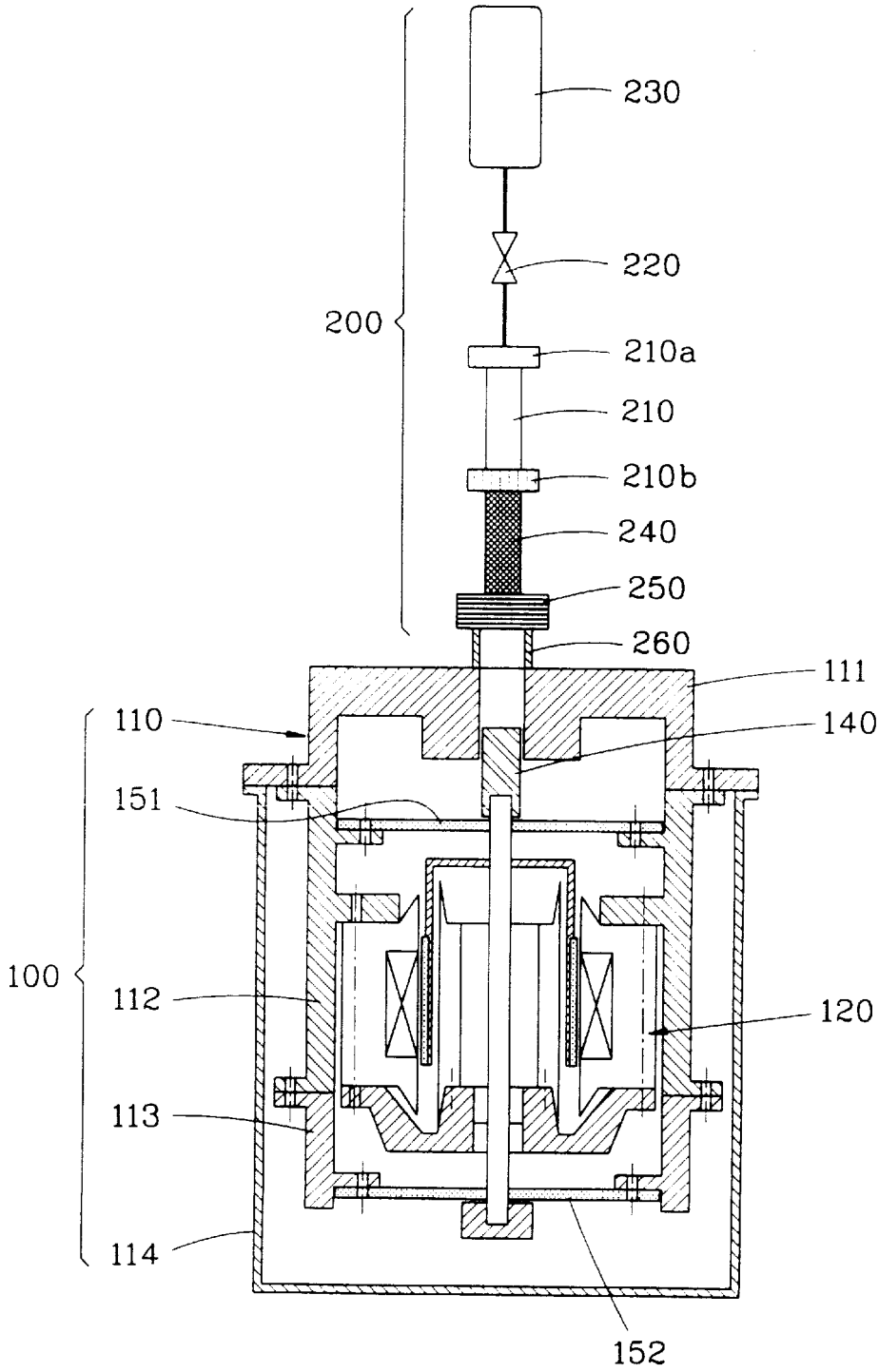
FIG. 7 is a vertical cross-sectional view illustrating an example of a compressor integrated pulse tube refrigerator of an oil free type according to a modification first embodiment of the present invention.
Figure 8:
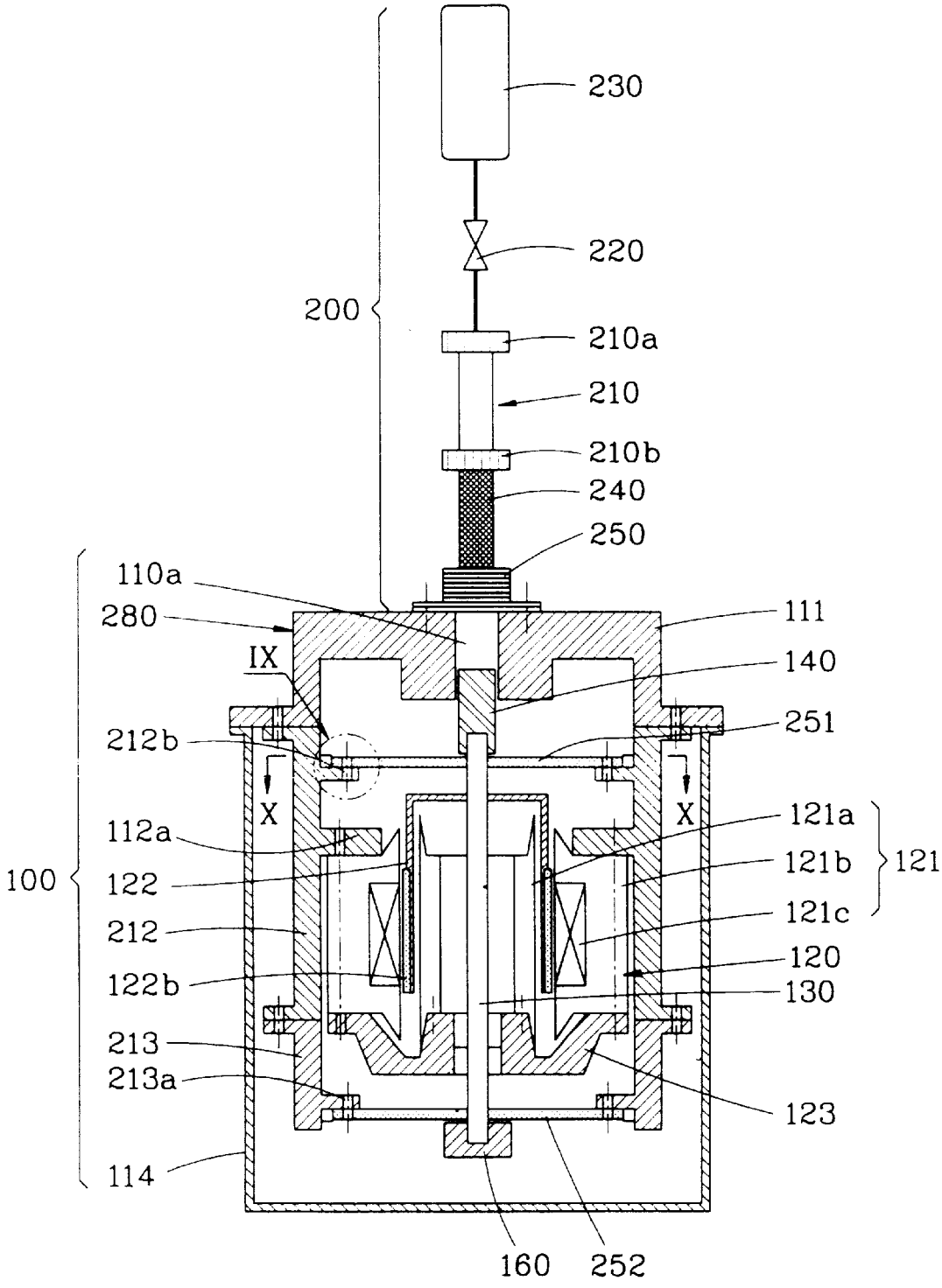
FIG. 8 is a vertical cross-sectional view illustrating a compressor integrated pulse tube refrigerator of an oil free type according to a second embodiment of the present invention.

In the first embodiment of the present invention, the pre-cooling unit 250 of the refrigerating unit 200 is mounted at the center portion of the upper surface of the cylinder 110*a* of the upper frame 111. In an example of the first embodiment of the present invention, as shown in FIG. 7, the pre-cooling unit 250 of the refrigerating unit 200 may be installed at a portion spaced apart from the cylinder using an additional connection tube 260, so that the heat generated at the cylinder 110*a* is not directly transferred to the pre-cooling unit 250, namely, is radiated to the outside.

The assembling sequence of the compressor integrated pulse refrigerator of an oil free type according to a first embodiment of the present invention will be explained as follows.

First, an outer lamination 121*b* of the driving motor 120 is engaged to the motor support portion 112*a* of the intermediate frame 112, and an inner lamination 121*a* is inserted into the interior of the outer lamination 121*b*, and then the inner and outer laminations 121*a* and 121*b* are integrally engaged using the connection ring 123.

Continuously, the rotor 122 engaged to the driving shaft 130 is positioned in a cavity formed between the inner lamination 121*a* and the outer lamination 121*b*, and the upper portion of the driving shaft 130 contacts with the upper surface of the first elastic guide support member engaging portion 112*b* and is engaged using the engaging member 170 so that the entire edge portions of the first elastic guide support member 151 contacts with the inner surface of the intermediate frame 112 in a state that the upper portion of the driving shaft 130 passes through the center portion of the first elastic guide support member 151.

The upper portion of the lower frame 113 is closely engaged to the lower portion of the intermediate frame 112, and the lower portion of the driving shaft 130 contacts with the lower surface of the second elastic guide support member engaging portion 113*a* and is engaged using the engaging member 170 so that the entire edge portions of the second elastic guide support member 152 contact with the inner surface of the lower frame 113 in a state that the lower portion of the driving shaft 130 passes through the center portion of the second elastic guide support member 152.

As shown in FIG. 5, the driving shaft 130 is tightly inserted into the piston 140 in a state that the first elastic guide support member 151 is positioned between the upper support shoulder portion 130*a* of the driving shaft 130 and the piston 140, and the lower portion of the driving shaft 130 is engaged to the fixing member 160 in a state that the second elastic guide support member 152 is positioned between the lower support portion 130*b* of the driving shaft 130 and the fixing member 160.

At this time, the piston 140 is assembled so that the gap between the outer surface of the piston 140 and the inner surface of the cylinder 110*a* is about 5? when the piston 140 reciprocates within the cylinder 110*a*, and the driving shaft engaging holes 151*a* and 152*a* of the first and second elastic guide support members 151 and 152 as shown in FIG. 6 and the cylinder 110*a* are concentrically arranged.

As shown in FIG. 5, the upper portion of the driving shaft 130 is tightly inserted into the piston 140 in a state that the first elastic guide support member 151 is positioned between the upper support shoulder portion 130*a* of the driving shaft 130 and the piston 140. The lower portion of the driving shaft 130 is engaged with the fixing member 160 in a state that the second elastic guide support member 152 is positioned between the lower support shoulder portion 130*b* of the driving shaft 130 and the fixing member 160.

At this time, the piston 140 is assembled so that the gap between the outer surface of the piston 140 and the inner surface of the cylinder is about 5 $\mu$m when the piston 140 reciprocates within the cylinder 110*a*, and as shown in FIG. 6, the driving shaft engaging holes 151*a* and 152*a* of the first and second elastic guide support members 151 and 152 are concentrical.

The upper frame 111 is engaged to the upper portion of the intermediate frame 112 in a state that the piston 140 is inserted into the cylinder 110*a*, and the lower portion of the upper frame 111 is sealingly engaged with the upper portion of the sealing shell 114 which surrounds the intermediate frame 112 and the lower frame 113.

The pre-cooling unit 250 is engaged at the upper portion of the cylinder 110*a*, and the reproducing unit 240, the pulse tube 210, the orifice 220, and the storing container 230 are sequentially engaged on the upper portion of the cooling unit 250.

The operation of the compressor integrated pulse tube refrigerator of an oil free type according to a first embodiment of the present invention will be explained with reference to the accompanying drawing.

When a power is applied to the driving motor 120, and the rotor 122 reciprocates based on an electric magnetic force, the driving shaft 130 engaged to the rotor 122 reciprocates. Therefore, the piston 140 integrally engaged with the driving shaft 130 reciprocates within the cylinder 110*a* for thereby pumping the working gas in the sealed casing 110.

During the compression cycle, the working gas of the cylinder 110*a* is discharged into the interior of the pre-cooling unit 250. The working gas in the interior of the pre-cooling unit 250 is cooled to a certain temperature and is flown into the interior of the pulse tube 210 in a state that a sensible heat is stored based on the heat exchange by the reproducing unit 240.

Therefore, the working gas filled in the interior of the pulse tube 210 is flown toward the orifice 220 by the working gas flown into the pulse tube 210 and is compressed, so that the temperature of the compression portion 210*a* of the pulse tube 210 is increased. The thusly increased temperature is adiabatically expanded by the orifice 220, and the heat is radiated to the outside.

In the pulse tube 210, a high pressure thermal balance state is obtained between the compression cycle and the expansion cycle during the operation of the refrigerator. At this time, the working gas is continuously flown from the pulse tube 210 to the storing container 230 via the orifice 220, so that the temperature of the pulse tube 210 is gradually decreased.

In the expansion cycle, the working gas flown into the pulse tube 210 is flown into the interior of the reproducing unit 240. At this time, since the amount of the mass flow rate of the working as flown into the pulse tube 210 via the orifice 220 is greatly smaller than that of the mass flow rate of the working gas from the pulse tube 210 via the reproducing unit 240, the working gas in the pulse tube 210 is adiabatically expanded.

The adiabatic expansion of the working gas is generated at the side of the expansion portion, namely, at the portion in which the cold end heat exchanger(not shown) is engaged, so that a ultra low temperature portion is formed at the expansion unit 210*b*.

In the pulse tube 210, a low pressure thermal balance state is implemented between the expansion cycle and the compression cycle during the operation of the refrigerator. During the above-described operation, the working gas is continuously flown from the storing container 230 to the pulse tube 210 via the orifice 220, so that the pressure of the working gas in the pulse tube 210 is increased, and the temperature of the pulse tube 210 is changed to the initial temperature before the operation is started.

Therefore, the piston 140 which is moved by receiving a reciprocating movement of the rotator 122 by the first and second elastic guide support members 151 and 152 engaged to the upper and lower portions of the driving shaft 130 reciprocates within the cylinder 110*a* based on a certain gap between the piston 140 and the cylinder 110*a*.

As described above, in the compressor integrated pulse tube refrigerator of an oil free type according to a first embodiment of the present invention, since the driving unit is integrally formed with the compression including the linear motor compared to the conventional art in which the driving unit of the conventional pulse tube refrigerator is formed of the compressor, the high pressure container, the low pressure container, the oil removing unit, etc., the pulse tube refrigerator is compact. Namely, in the present invention, the high/low pressure containers, the oil removing unit, etc. are removed, so that the number of the assembling processes is significantly decreased, and the assembling processes and the assembling time are significantly decreased.

In addition, in the conventional art, a valve is needed for separately communicating the high and low pressure containers and the refrigerating unit for pumping the working gas, so that the working gas which flows through the valve is expanded for thereby decreasing the efficiency of the refrigerating unit. However, in the present invention, the driving unit and the refrigerating unit are directly connected, so that the working gas is pumped only by the reciprocating operation of the piston, whereby a valve is not additionally used for thereby increasing the efficiency of the refrigerating unit.

In addition, in the conventional art, the oil removing unit is provided in order to prevent the oil from being flown from the compressor into the refrigerating unit, so teat the oil removing unit is periodically changed. However, in the present invention, since the driving unit supports the resonance movement and straight reciprocating movement of the piston using the support member engaged to the driving shaft, a certain oil such as a lubricating oil is not used for preventing any friction between the outer surface of the piston and the inner wall of the cylinder. Therefore, in the present invention, the period for the maintenance is extended, and the refrigerator is widely applicable to a sensor cooling system such as a satellite system.

In the following embodiments of the present invention, since the structure of the refrigerating unit is similar to the first embodiment of the present invention. The structure of the driving unit is explained.

The same elements as the first embodiment of the present invention will be given the same reference numerals.

In the following descriptions, the descriptions on the directions such as an upper, lower, leftward, and rightward direction are determined based on the directions as shown in FIG. 4.

The compressor integrated pulse tube refrigerator of an oil free type according to a second embodiment of the present invention will be explained with reference to the accompanying drawings.

As shown in FIGS. 8 through 11B, the compressor integrated pulse tube refrigerator of an oil free type according to the second embodiment of the present invention includes a sealed casing 280, a driving motor 120, a driving shaft 130, a piston 140, a first elastic guide support member 251, and a second elastic guide support member 252.

The structure of the upper frame 111 and the sealed sheel 314 which form the sealed casing 280 is the same as the first embodiment of the present invention except for the structures of the intermediate frame 212, the lower frame 213, and the support members 251 and 252. Therefore, only the different structures will be explained.

Figure 9:
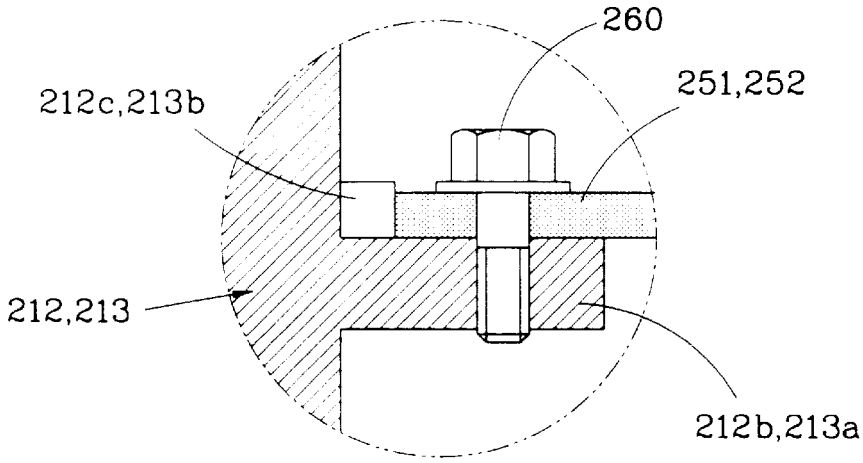
FIG. 9 is a view illustrating the portion IX of FIG. 8.
Figure 10:
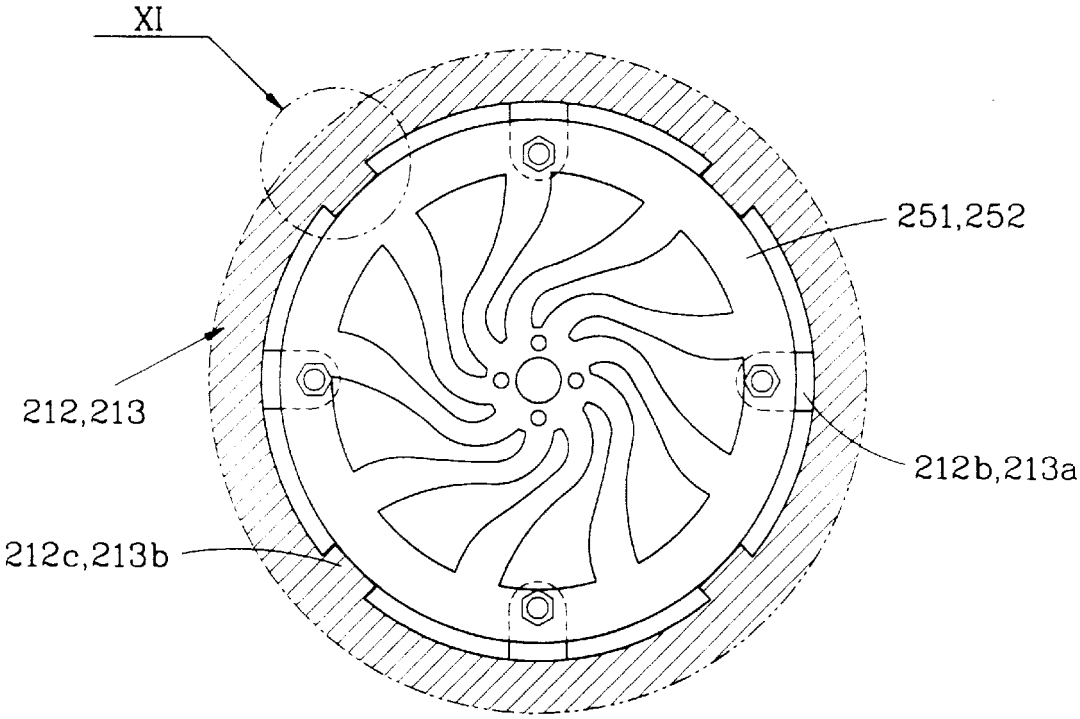
FIG. 10 is a view illustrating a cross-sectional view taken along line X—X of FIG. 10.

As shown in FIGS. 9 and 10, four support protrusions 212*c* and 213*b* are inwardly protruded at each inner surface of the intermediate and lower frames 212 and 213, namely, the upper surfaces or lower surfaces of the support member engaging portions 212*b* and 213*a*, in the direction of the interior of the sealed casing 280 for minimizing the area contacting with the inner surfaces of the intermediate and lower frames and the outer surfaces of the first and second elastic guide support members 251 and 252.

At this time, the inner diameters of the support member engaging portions 212*b* and 213*a* are smaller than the outer diameter of the motor support portion 112*a*.

Figure 11A:
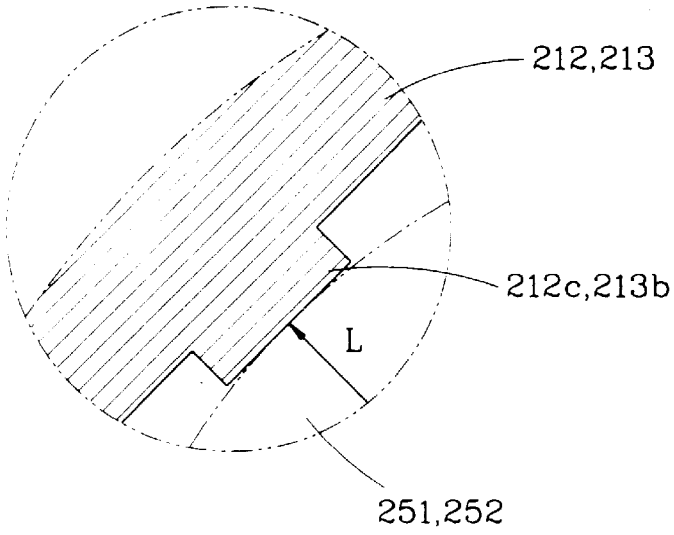
FIG. 11A is a view illustrating the portion XI of FIG. 10.
Figure 11B:
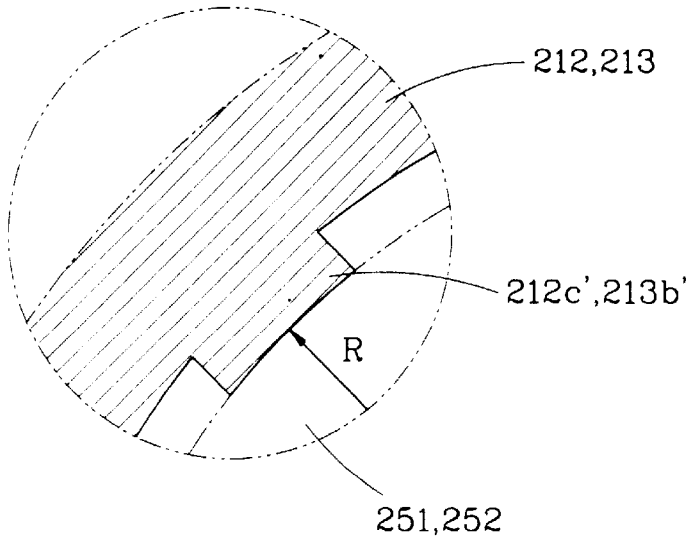
FIG. 11B is a detailed view illustrating the portion XI of FIG. 10.
Figure 12:
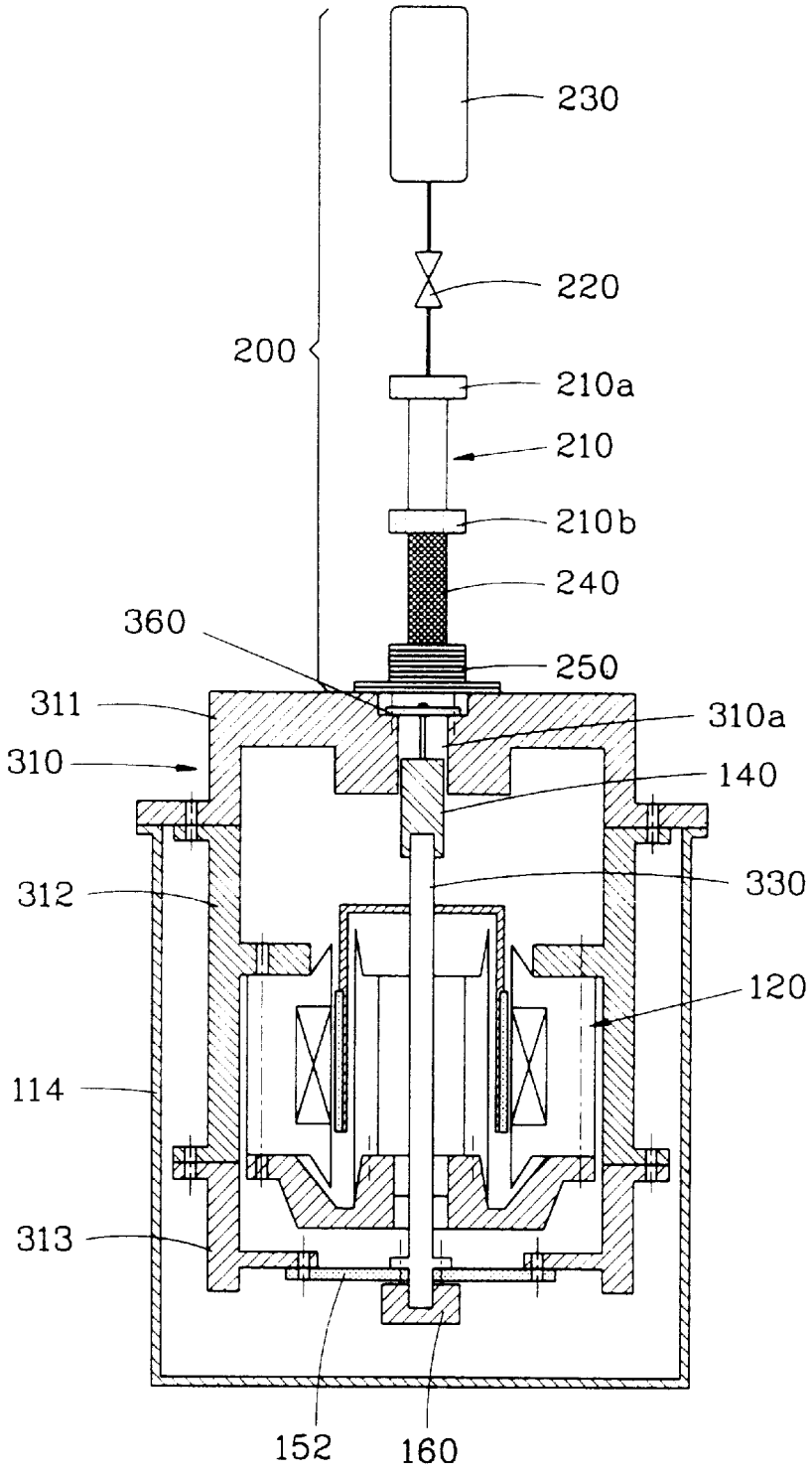
FIG. 12 is a vertical cross-sectional view illustrating a compressor integrated pulse tube refrigerator of an oil free type according to a third embodiment of the present invention.

As shown in FIG. 11A, the inner surfaces of the support protrusions 212*c* and 213*b* may be formed in linear shapes 212*c* and 213*b*, and as shown in FIG. 11B, may be formed in curved shapes 212*c*' and 213*b*' having the same curved radius as the radiuses of the plate springs 251 and 252.

The processes for assembling the driving apparatus of the compressor integrated pulse tube refrigerator of an oil free type according to a second embodiment of the present invention will be explained.

First, the driving motor 120 is engaged to the motor support portion 112*a* of the intermediate frame 212, and the driving shaft 130 passes through the center portion, and the first elastic support member 251 is engaged to the support member engaging portion 212*b* of the intermediate frame 212. The lower frame 213 is engaged to the lower portion of the intermediate frame 212, and the second elastic guide support member 252 having its center portion passed through by the lower portion of the driving shaft 130 is engaged to the second elastic guide support member engaging portion 213*a* of the lower frame 213.

At this time, the support members 251 and 252 are placed on the support member engaging portions 212*b* and 213*a*, and the outer surfaces of the support members 251 and 252 are closely contacts with the inner surfaces of the support protrusions 212*c* and 213*b* formed on the upper surface of the support member engaging unit for thereby being concentrically arranged with the cylinder 110*a*. In this process, in the case that the structures of the support protrusions 212*c* and 213*b* are linear as shown in FIG. 11A, the diameters of the first and second elastic guide support members 251 and 252 are the same as the length L between the inner surfaces of two support protrusions in the diagonal direction at the intermediate and lower frames, so that the outer surfaces of the support members 251 and 252 tangentially contact with the inner surface centers of the support protrusions 212*c* and 213*b*.

As shown in FIG. 11B, in the case that the support protrusions 212*c*' and 213*b*' have the same radiuses as the radiuses of the support members 251 and 252, the outer surfaces of the support members 251 and 252 are surface-contacted with the inner surfaces of the support protrusions 212*c*' and 213*b*', so that the support members 251 and 252 are fixed.

In FIGS. 11A and 11B, L and R represent a tangential contact and a surface, respectively.

The upper frame 111 is engaged to the upper portion of the intermediate frame 212 in a state that the piston 140 is positioned to be inserted into the cylinder 110*a*, and the sealing shell 114 which surrounds the intermediate frame 212 and the lower frame 213 is engaged to the lower portion of the upper frame 111.

The operation of the compressor integrated pulse tube refrigerator of an oil free type according to the second embodiment of the present invention is the same as the first embodiment of the present invention. Therefore, the description of the same will be omitted.

As described above, in the compressor integrated pulse tube refrigerator of an oil free type according to the present invention, a plurality of linear shaped or curved support protrusions are formed to have steps with respect to the support members on the inner surface contacting with the support members so that the edge surfaces of the support members closely contact with the upper and lower portions of the inner surface of the sealed casing in which the support members are concentrically fixed. Therefore, it is easy to fabricate the refrigerator by concentrically arranging the inner surfaces of the intermediate and lower frames closely supported by the support members with the support members for thereby implementing an easier engaging and disengaging operation of the support members, and enhancing the assembling effects.

The compressor integrated pulse tube refrigerator of an oil free type according to a third embodiment of the present invention will be explained with reference to the accompanying drawings.

As shown in FIGS. 12 through 15, the compressor integrated pulse tube refrigerator of an oil free type according to a third embodiment of the present invention includes a sealed casing 310, a driving motor 120, a driving shaft 330, a piston 340, a first elastic guide support member 360, and a second elastic guide support member 152.

The third embodiment of the present invention will be explained by focusing on the structure of the sealed casing 310, the structure and installation position of the first elastic guide support member 360, and the engaging method between the first elastic guide support member 360 and the piston 140, and the structure of the cylinder 310*a* which are the major features of the third embodiment of the present invention.

The first elastic guide support member 360 according to the third embodiment of the present invention is installed in the interior of the cylinder 310*a*.

In the sealed casing 310, there is provided an upper frame 311. A cylinder 310*a* into which a piston 340 is inserted and reciprocates therein is installed at the upper frame 311. A first elastic guide support member 360 is installed at the upper frame 311 for guiding a reciprocating movement of the piston. An intermediate frame 312 is tightly engaged to the lower surface of the upper frame 311. A driving motor 320 is fixed to the intermediate frame 312. A lower frame 313 is engaged to the lower surface of the intermediate frame 312. A second elastic guide support member 152 is engaged to the lower portion of the driving shaft 330 for enabling a reciprocating movement of the piston 340. A sealing shell 114 surrounds the intermediate frame 312 and the lower frame 313. The upper portion of the sealing shell 114 is sealingly engaged to the lower surface of the upper frame 311 for preventing a leakage of the working gas from the sealed casing 310.

Figure 13:
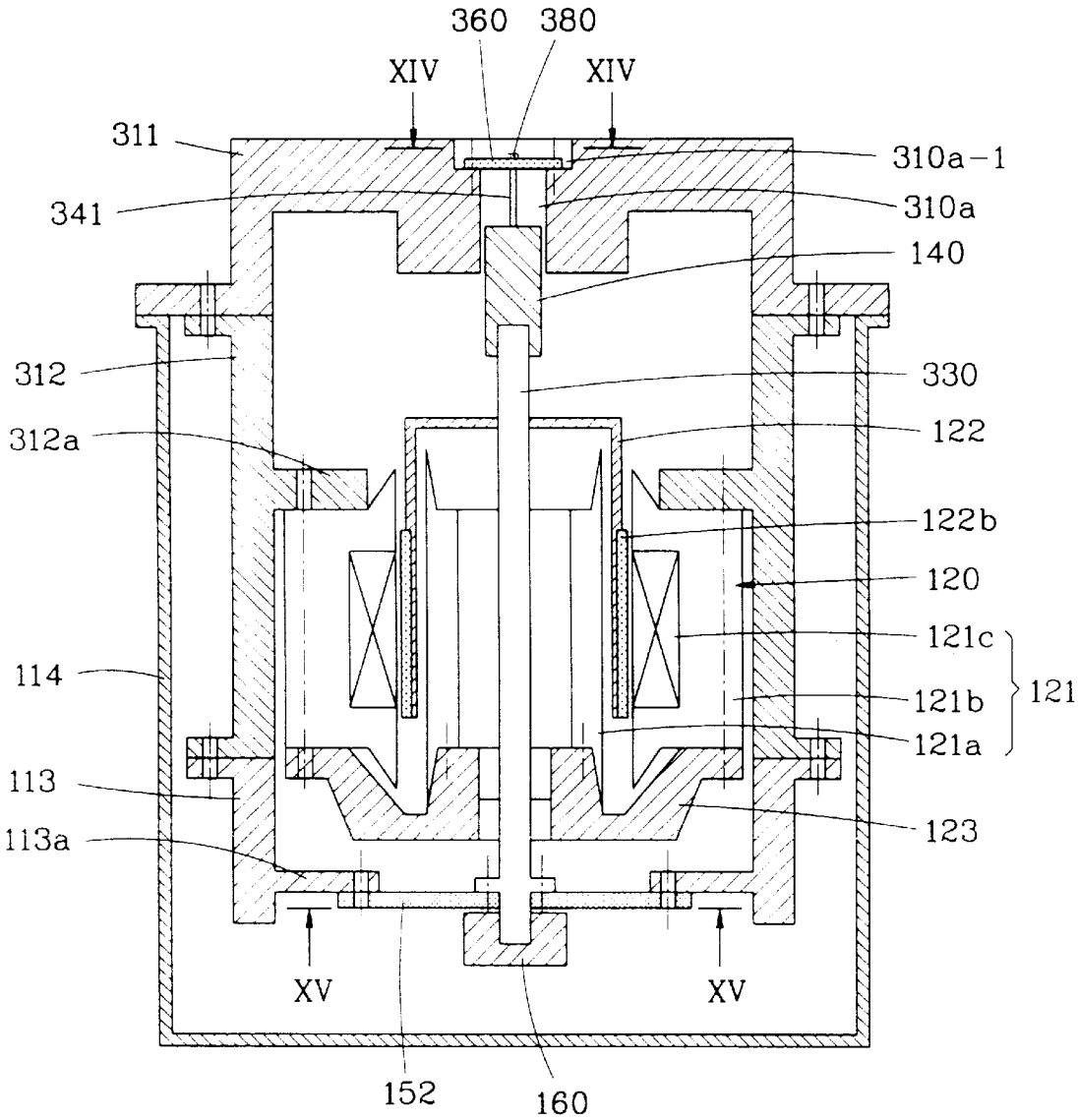
FIG. 13 is an enlarged vertical cross-sectional view illustrating a driving unit for a compressor integrated pulse tube refrigerator of an oil free type according to a third embodiment of the present invention.

In detail, as shown in FIG. 13, at the upper end portion of the cylinder 310*a* into which the piston 340 of the upper frame 311 is inserted, the first elastic guide support member engaging groove 310*a*-1 for receiving the first elastic guide support member 360 therein has a radius greater than the cylinder 310*a* and is concentric with respect to the cylinder 310*a*.

At this time, a connection rod 341 is upwardly extended and is engaged with the first elastic guide support member 360 at the upper center portion of the piston 140, and the upper end of the driving shaft 330 is tightly inserted into the lower end of the piston 140.

A motor support portion 312*a* is formed on an inner surface of the intermediate frame 312 for engaging an outer side lamination 321*b* of the driving motor 320, concentrically with respect to the cylinder 310*a*.

A plurality of second elastic guide support member engaging portions 113*a* (in protrusion shapes) to which the second elastic guide support members 152 are engaged are formed on the inner surface of the lower frame 113 in the radial direction from the inner surface of the lower frame 113, concentrically with respect to the cylinder 310*a*.

The driving shaft 330 is integral with the rotor 122 of the driving motor 120 and passes through the stator 121. The upper portion of the driving shaft 300 is inserted into the piston 140, and the lower portion of the driving shaft 300 passes through the center portion of the second elastic guide support member 152 and is engaged by the fixing member 160.

Figure 14:
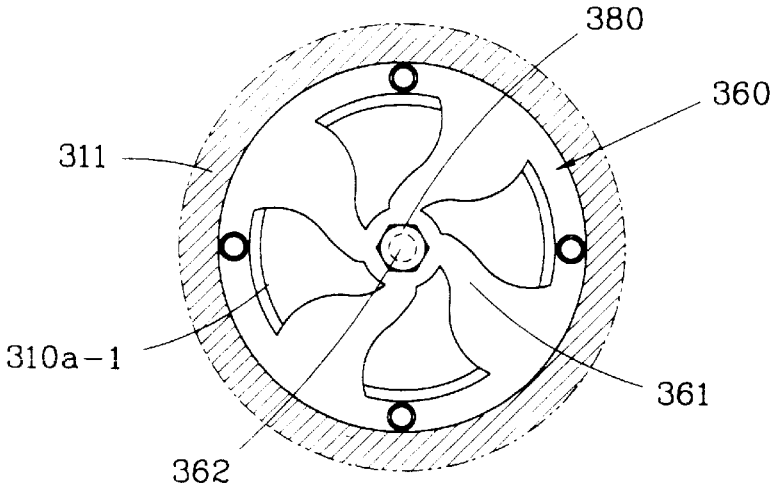
FIG. 14 is a cross-sectional view taken along line XIV—XIV of FIG. 13.
Figure 15:
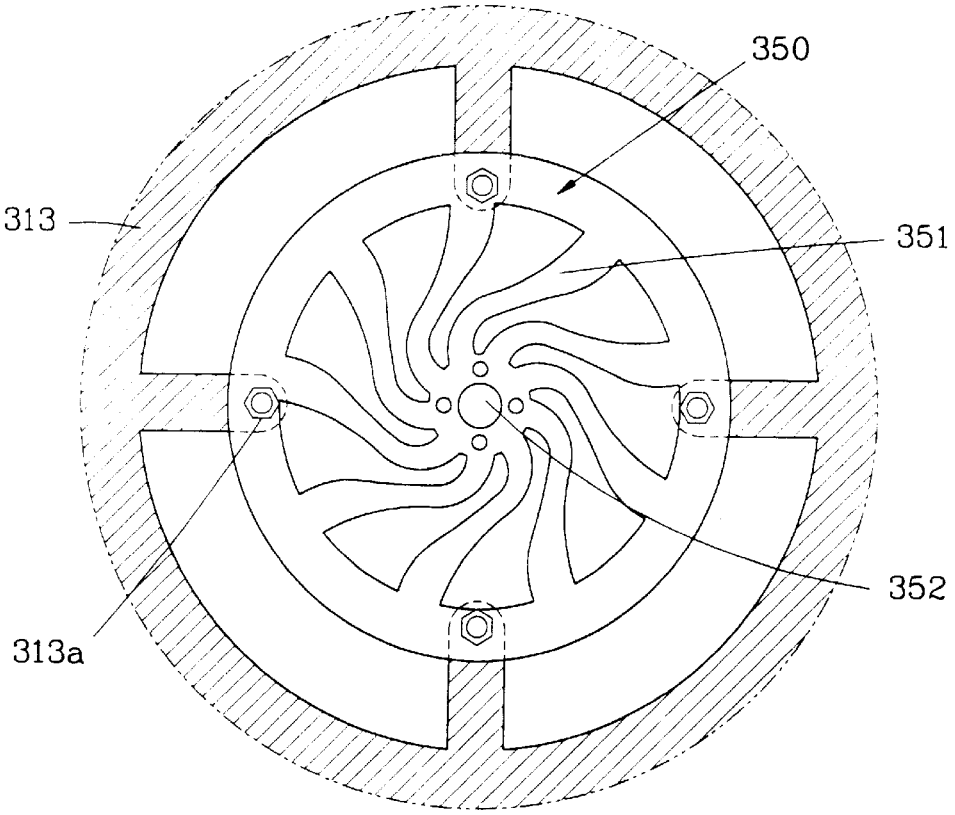
FIG. 15 is a cross-sectional view taken along line XV—XV of FIG. 13.

The first and second elastic guide support members 360 and 152 are formed of a spiral plate spring, and as shown in FIG. 14, in the first elastic guide support member 360, the space between the neighboring elastic portions 361 is wide so that the working gas pumped by the piston 340 is effectively flown. As shown in FIG. 15, in the elastic portion 351 of the second elastic guide support member 152, the space between the neighboring elastic portions 361 is narrow so that the piston 340 smoothly reciprocates.

In addition, the connection rod engaging hole 362 and the driving shaft engaging hole 352 formed at the centers of the first elastic guide support member 360 and the second elastic guide support member 152 are concentric.

The driving apparatus for a compressor integrated pulse tube refrigerator of an oil free type according to the third embodiment of the present invention is assembled by the following sequence.

First, the outer side lamination 121*b* of the driving motor 120 is engaged to the motor support portion 312*a* of the intermediate frame 312. The inner side lamination 121*a* is inserted into the outer side lamination 121*b*. Thereafter, the inner and outer side laminations 121*a* and 121*b* are integrally engaged using the connection ring 123. A cylindrical rotor 122 engaged with the driving shaft 330 is disposed at the space between the inner and outer side laminations 121*a* and 121*b*.

Next, the second elastic guide support member 152 is engaged to the lower frame 113, and the driving shaft 330 is engaged to the second elastic guide support member 152, and the fixing member 160 is engaged to the lower portion of the driving shaft 330 for thereby fixing the second elastic guide support member 152.

Next, the piston 140 is engaged to the upper portion of the driving shaft 330, and the upper frame 311 is engaged to the intermediate frame 312 so that the piston 140 is inserted into the cylinder 310*a* to have a certain gap between the piston 140 and the cylinder 310*a*. The first elastic guide support member 360 is engaged to the first elastic guide support member engaging groove 310*a*-1 of the cylinder 310*a*. At this time, the connection rod 341 of the piston 340 which passes through the center portion of the first elastic guide support member 360 is tightened using the engaging member 380, so that the first elastic guide support member 360 is integrally engaged with the piston 140.

The sealing shell 114 which surrounds the intermediate frame 312 and the lower frame 113 is engaged to the lower surface of the upper frame 311.

The features of the compressor integrated pulse tube refrigerator of an oil free type according to the third embodiment of the present invention will be explained.

The first elastic guide support member 360 engaged to the upper portion of the driving shaft 330 supports in the radial direction of the piston 140 so that the piston 140 which is moved by receiving the linear movement of the rotor 122 reciprocates at a certain gap with respect to the inner wall of the cylinder 310*a*.

Namely, when the piston 140 reciprocates together with the driving shaft 330, since the first elastic guide support member 360 engaged with the connection rod 341 which is extended from the piston 140 is engaged with the upper frame 311 at which the cylinder 310 is formed, the piston 140 is not radially leaned in a certain direction.

Since the first elastic guide support member 360 and the second elastic guide support member 152 which guide the linear reciprocating movement of the piston 140 are engaged to both ends of the piston 140, it is possible to significantly prevent a leaning phenomenon by the weight of the piston 140 or an external force compared to when the first elastic guide support member 360 and the second elastic guide support member 152 are engaged in a certain direction of the piston 140.

In addition, since the gap between the cylinder 310*a* and the piston 140 is easily checked after the piston 140 is inserted into the cylinder 310*a*, it is easy to implement a concentric engagement of the first elastic guide support member 360.

As described above, in the compressor integrated pulse tube refrigerator of an oil free type according to a third embodiment of the present invention, the support members which enables the piston to continuously reciprocate are installed at both sides of the piston, it is possible to minimize the leaning phenomenon of the piston, so that an abrasion of the piston and cylinder is prevented, and the leakage of the working gas is prevented. When assembling the system, the first elastic guide support member may be assembled after the piston is assembled, so that it is easy to implement a concentricity between the piston and the cylinder.

The compressor integrated pulse tube refrigerator for an oil free type according to the fourth embodiment of the present invention will be explained with reference to the accompanying drawings.

Figure 16:
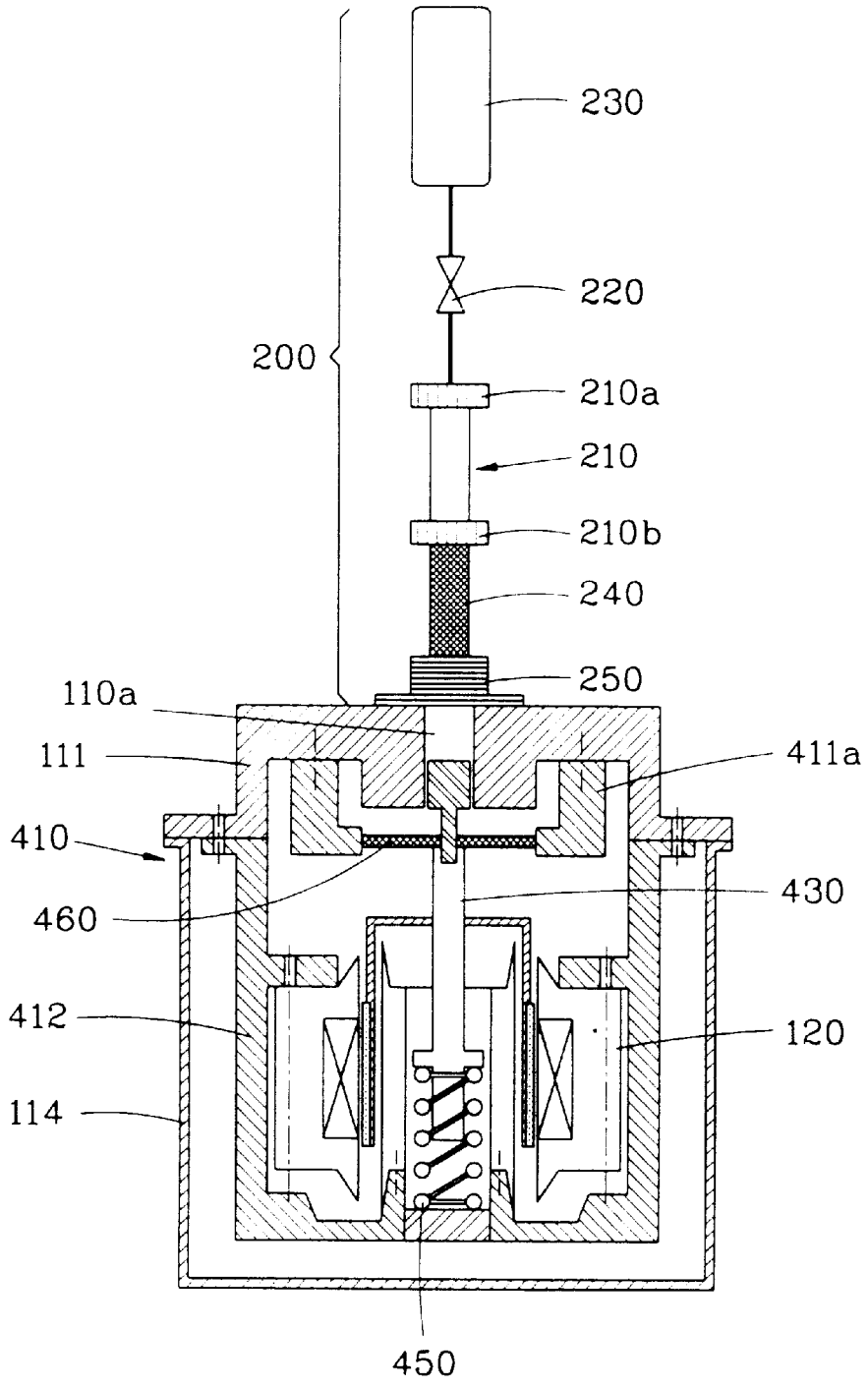
FIG. 16 is a vertical cross-sectional view illustrating a compressor integrated pulse tube refrigerator of an oil free type according to a fourth embodiment of the present invention.
Figure 17:
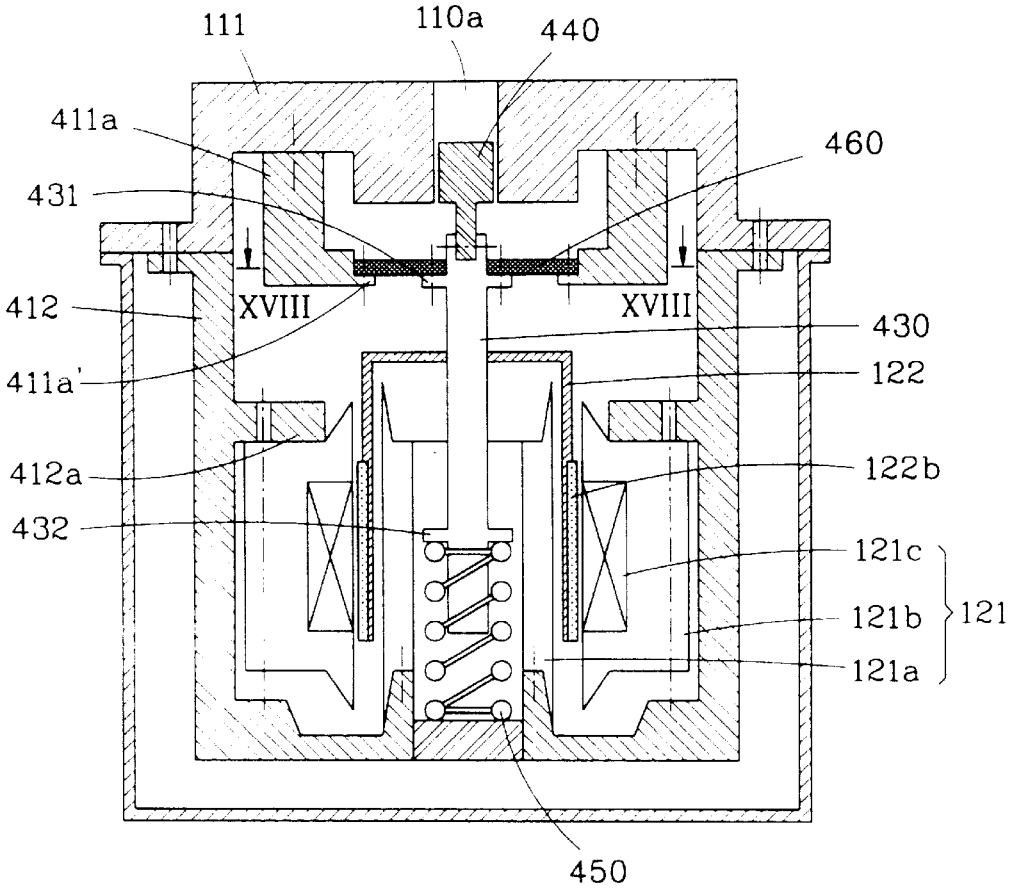
FIG. 17 is an enlarged vertical cross-sectional view illustrating a driving unit for a compressor integrated pulse tube refrigerator of an oil free type according a fourth embodiment of the present invention.
Figure 18:
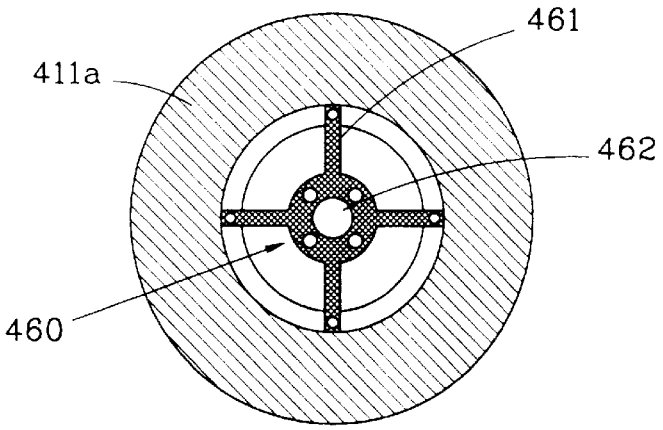
FIG. 18 is a cross-sectional view taken along line XVIII—XVIII of FIG. 17.

As shown in FIGS. 16 through 18, the compressor integrated pulse tube refrigerator of an oil free type according to the fourth embodiment of the present invention includes a sealed casing 410, a driving motor 120, a driving shaft 430, a piston 440, an elastic support member 450, and a guide support member 460.

The fourth embodiment of the present invention will be explained by focusing on the structure of the sealed casing 410, the structures and installation positions of the guide support member 460 and the elastic support member 450, and the structures of the driving shaft 430 and the piston 440.

In the sealed casing 410, the cylinder 110*a* into which the cylinder 440 is inserted and reciprocates therein is installed at the upper frame 111. The fixing member 411*a* is engaged for engaging the guide support member 460. The lower frame 412 is engaged to the lower surface of the upper frame 111. The driving motor 120 is installed in the interior of the lower frame 412. The elastic support member 450 engaged to the lower portion of the driving shaft 430 is engaged at the lower frame 412. The sealing shell 114 is sealingly engaged to the lower surface of the upper frame 111 for surrounding the lower frame 412 and preventing a leakage of the working gas from the sealed casing 410.

The fixing member 411*a* engaged to the upper frame 111 may be separately assembled or the same may be integrally formed of the upper frame 411. The guide support member engaging portion 411*a*' is formed in a step form so that the guide support member 460 is placed on the same and is engaged thereto.

The motor support portion 412*a* is circumferentially protruded on the inner surface of the lower frame 412 for engaging the stator of the driving motor 120, and the lower portion of the elastic support member 450 is placed at the center portion of the bottom surface and is supported thereby.

An upper portion of the elastic support member 450 is a compression coil spring inserted onto the lower end of the driving shaft 430 and generates a resonance movement during the reciprocating movement of the rotor 122 of the driving motor 120. In addition, the upper portion of the same is supported by the driving shaft 430, and the lower portion of the same is supported by the bottom surface of the lower frame 312.

As shown in FIGS. 17 and 18, the guide support member 460 elastically operates during the reciprocating movement of the piston 440, and an edge portion of the same is engaged to the upper frame 111 for maintaining a linear movement of the piston 440, and the inner surface of the same is engaged to the driving shaft 430. The elastic portion 461 is formed of a circular plate spring which may be formed in a spiral shape or a radial shape. The driving shaft engaging hole 462 is concentrically formed with respect to the cylinder 110*a* of the upper frame 111 for implementing a linear movement of the piston 440.

The structure of the driving motor 120 is similar to the first embodiment of the present invention. The inner and outer side laminations 121*a* and 121*b* are engaged at the lower frame 412 of the sealed casing 410.

The driving shaft 430 is integrally engaged with the rotor 122 of the driving motor 120. The upper support shoulder portion 431 is formed at the driving shaft 430 so that the piston 440 is integrally engaged with the upper portion of the same, and the guide support member(plate spring) 460 is engaged on the upper outer surface. The lower support shoulder portion 432 is formed at the lower portion, so that the compression coil spring which is the elastic support member 450 is inserted into the lower support shoulder portion 432.

The compressor integrated pulse tube refrigerator of an oil free type according to the fourth embodiment of the present invention is assembled as follows.

First, the inner and outer side laminations 121*a* and 121*b* of the stator 121 of the driving motor 120 are engaged to the lower frame 412, and the driving shaft 430 into which the support member 450 is inserted is inserted into the center portion of the inner side lamination 121 a, and the rotor 122 of the driving motor 120 which is integral with the driving shaft 430 is disposed in the hole formed between the inner and outer side laminations 121*a* and 121*b*.

Continuously, the upper end portion of the driving shaft 430 passes through the driving shaft engaging hole 462 of the guide support member 460, and an edge portion of the guide support member 460 is engaged to the fixing member 411*a*, and the piston 440 is engaged to the upper portion of the driving shaft 430. The upper frame 111 is engaged to the fixing member 411*a* so that the piston 440 is inserted into the cylinder 410*a*, and the upper frame 111 is engaged to the lower frame 412.

The sealing shell 114 is engaged to the lower surface of the upper frame 111 for thereby preventing a leakage of the working gas.

The operation of the compressor integrated pulse tube refrigerator of an oil free type according to the fourth embodiment of the present invention will be explained.

The guide support member 460 for the compressor integrated pulse tube refrigerator of an oil free type according to the fourth embodiment of the present invention may be a plate shape spring having an elastic portion and guides the linear movements of the driving shaft 430 and the piston 440 during the reciprocating movement of the rotor 122. The compression coil spring 450 which is the elastic support member engaged to the lower portion of the driving shaft 430 enables a continuous reciprocating movement of the driving shaft 430 and the piston 440 by inducing a resonance movement of the rotor 122, so that the elastic support member 450 is not applied with an over load for thereby preventing any damages of the same. When fabricating and assembling the elastic support member 450, it is easy to implement a concentric arrangement with respect to the guide support member 460, and the guide support member 460 may be formed in various shapes.

In the fourth embodiment of the present invention, the sealed casing is formed of two frames and the sealing shell, so that the size of the pulse tube refrigerator is small.

As described above, in the compressor integrated pulse tube refrigerator of an oil free type according to the fourth embodiment of the present invention, the elastic support member which implements a continuous reciprocating movement of the piston is substituted with a compression coil spring which is capable of enduring a certain degree fatigue limit, so that the damage of the elastic support member is prevented, and the fabrication and assembly of the elastic support member is easy. In addition, the guide support member is formed in various shapes, and the size of the pulse tube refrigerator may be small.

The compressor integrated pulse tube refrigerator of an oil free type according to a fifth embodiment of the present invention will be explained with reference to the accompanying drawings.

Figure 19:
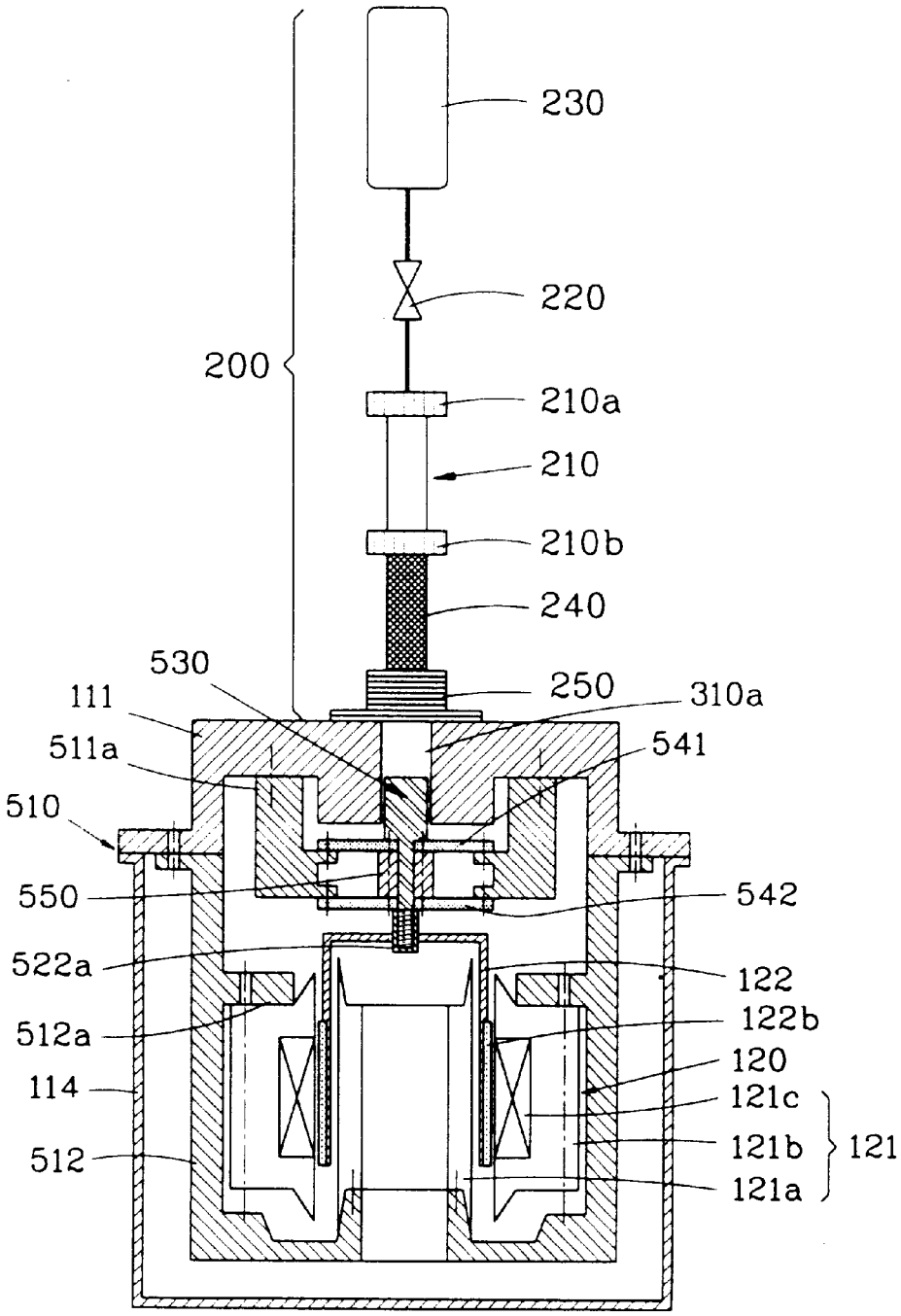
FIG. 19 is a vertical cross-sectional view illustrating a compressor integrated pulse tube refrigerator of an oil free type according to a fifth embodiment of the present invention.
Figure 20:
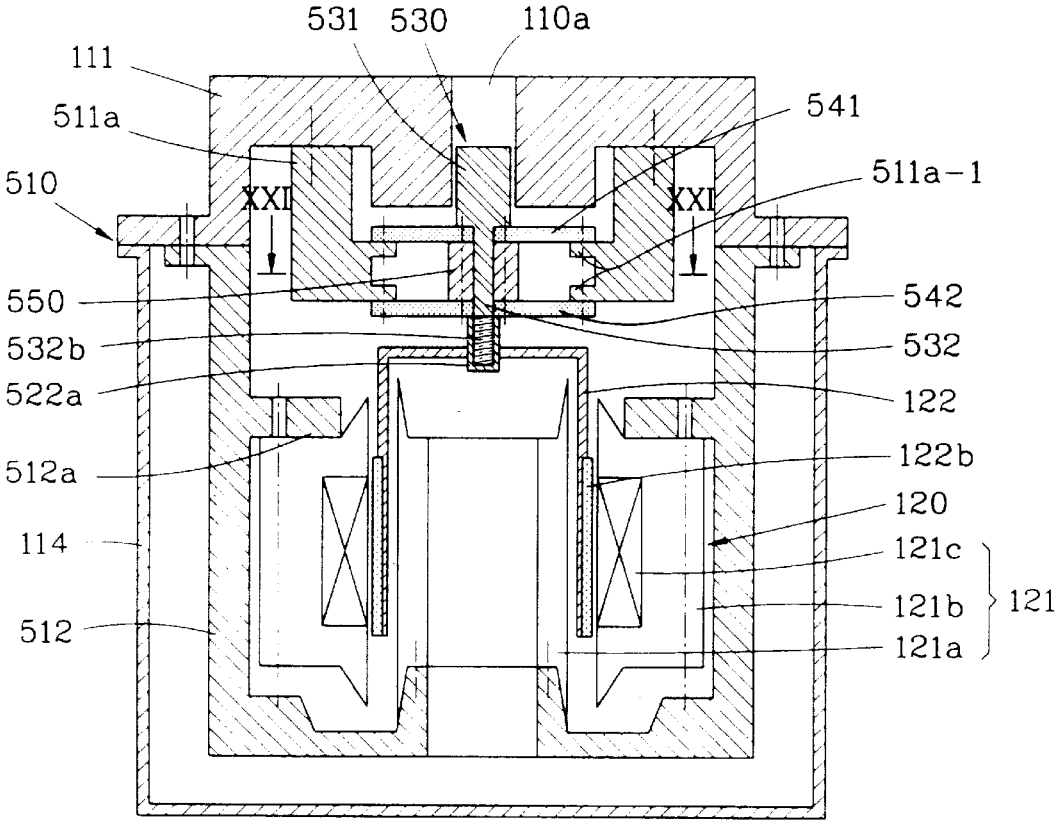
FIG. 20 is an enlarged vertical cross-sectional view illustrating a driving unit for a compressor integrated pulse tube refrigerator of an oil free type according to a fifth embodiment of the present invention.
Figure 21:
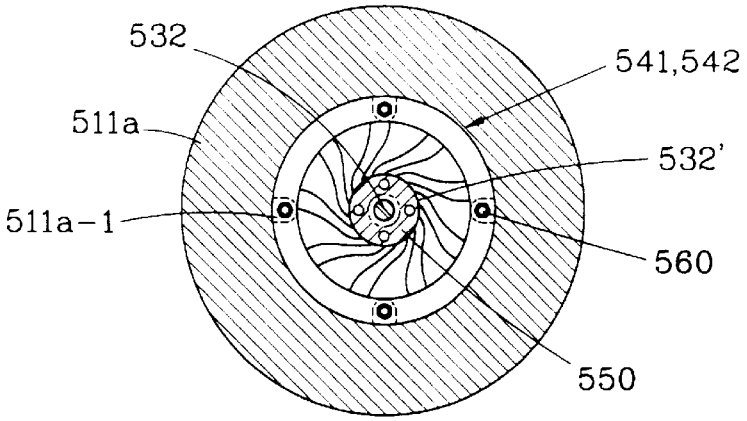
FIG. 21 is a cross-sectional view taken along line XXI—XXI of FIG. 20.
Figure 22:
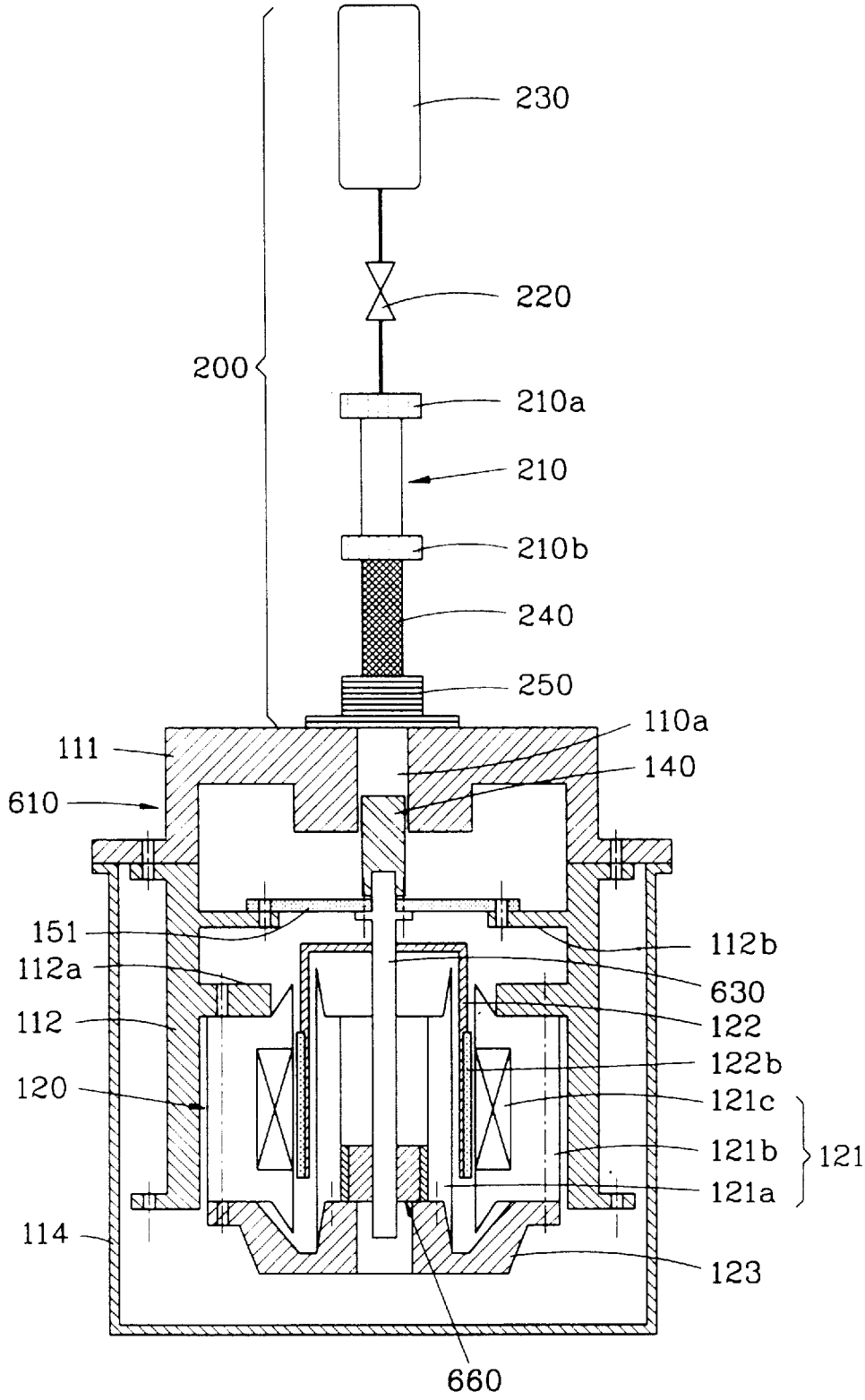
FIG. 22 is a vertical cross-sectional view illustrating a compressor integrated pulse tube refrigerator of an oil free type according to a sixth embodiment of the present invention.
Figure 23:
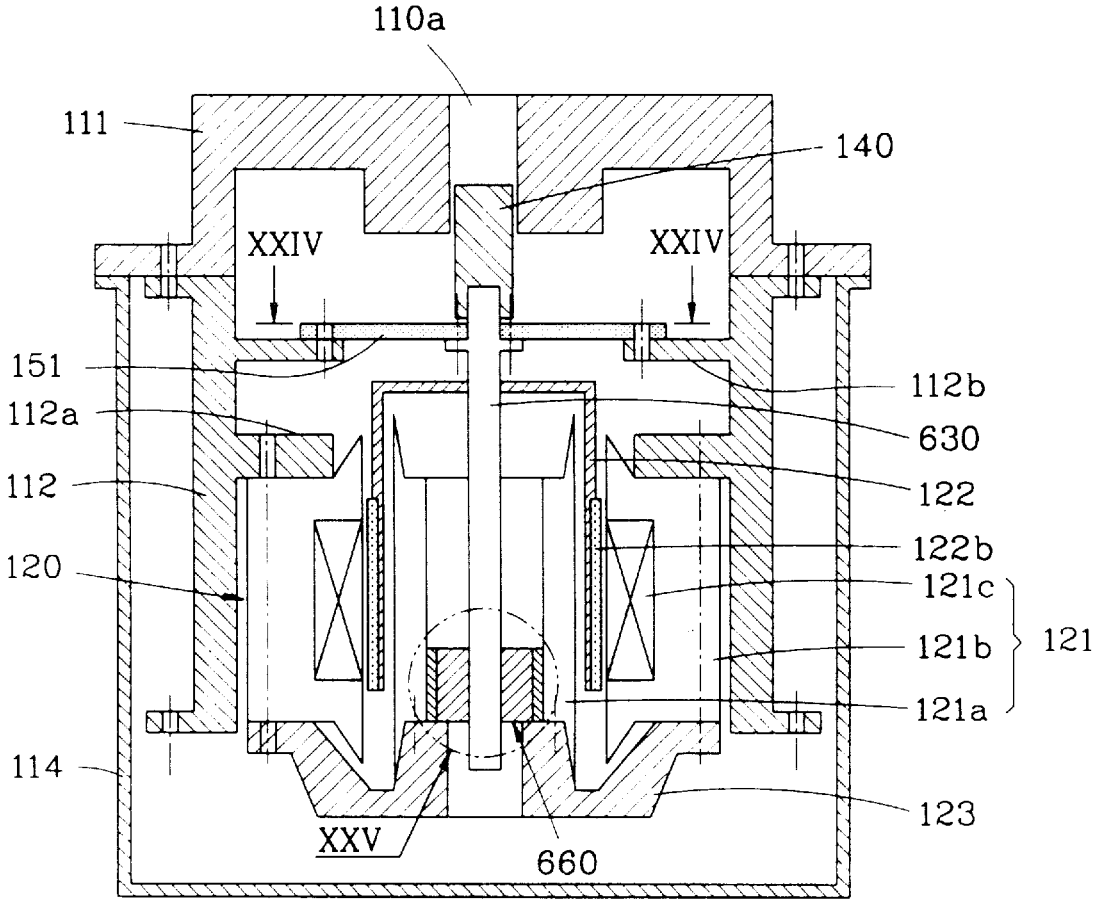
FIG. 23 is an enlarged vertical cross-sectional view illustrating a driving unit for a compressor integrated pulse tube refrigerator of an oil free type according to a sixth embodiment of the present invention.

As shown in FIGS. 19 through 21, the driving unit of the compressor integrated pulse tube refrigerator of an oil free type according to the fifth embodiment of the present invention includes a sealed casing 510, a driving motor 120, a piston 530, and a plurality of elastic guide support members 541 and 542.

In the sealed casing 510, the cylinder 110*a* into which the piston 530 is inserted and reciprocates therein is installed at the upper frame 111, and the edge portions of two elastic guide support members 541 and 542 are engaged at the inner portion of the upper frame 111. The lower frame 512 in which the driving motor 120 is installed is engaged to the lower surface of the upper frame 111. The sealing shell 114 is sealingly engaged to the lower surface of the upper frame 111 for surrounding the lower frame 512 for thereby preventing a leakage of the working gas.

In detail, a circular fixing member 311*a* is integrally engaged to the lower surface of the upper frame 111 for engaging the elastic guide support members 541 and 542. The elastic guide support members 541 and 542 engaged to the piston are engaged at both surfaces of the fixing member 311 a at a certain distance therebetween. A ring shape spacer 550 is disposed between the elastic guide support members 541 and 542 so that the driving motor 120 does not receive a certain load by the support members 541 and 542 having different cycles.

As shown in FIGS. 20 and 21, four protruded support member engaging portions 511*a*-1 are formed at both inner ends of the fixing member 511*a* on the same circumferential portions so that the elastic guide support members 541 and 542 have a certain elastic force, respectively.

The piston 530 according to the fifth embodiment of the present invention includes a head portion 531 inserted into the cylinder 510*a*, and a shaft portion 532 extended from the head portion 531 and engaged to the elastic guide support members 541 and 542. A threaded portion 532*b* is formed at the extended lower portion of the shaft portion 532 and is engaged with a nut shaped engaging member 522*a* engaged at the center portion of the rotor 122.

The elastic guide support members 541 and 542 are formed of a spiral type circular plate spring, respectively. As shown in FIG. 21, the edge portions of the elastic guide support members 541 and 542 are engaged to the support member engaging portions 511*a*-1 of the fixing member 511*a* of the upper frame 511, and the center portion of the same is integrally engaged to the fixing member 511*a* by a plurality of lengthy bolts 560 which pass through the support members 541 and 542. The upper surface of the first elastic guide support member 541 closely contacts with the lower surface of the head portion 531 of the piston 530. The lower surface of the second elastic guide support member 542 closely contacts with the upper surface of the nut shaped engaging member 522*a* engaged with the shaft portion 532 of the piston 530.

In addition, the elastic guide support members 541 and 542 each include a piston engaging hole 532', through which the piston 530 passes through, formed at the center portions of the same. The piston engaging hole 532' is concentrically formed with respect to the cylinder 110*a* of the upper frame 111 so that the outer surface of the piston 530 does not contact with the inner surface of the cylinder 110*a*.

The driving apparatus for a compressor integrated pulse tube refrigerator of an oil free type according to the fifth embodiment of the present invention is assembled in the following method.

First, the shaft portion 532 of the piston 530 is inserted into the first elastic guide support member 541 and the spacer 550, and the edge portion of the first elastic guide support member 541 is engaged to the support member engaging portion 511*a*-1 formed at the upper portion of the fixing member 511*a*.

The second elastic guide support member 542 is inserted into the shaft portion 532 of the piston 530, and the edge portion of the second elastic guide support member 542 is engaged to the lower surface of the support member engaging portion 511*a*-1 of the fixing member 511*a*.

The shaft portion 532 of the piston 530 is threaded to the engaging member 522*a* which is integral with the rotor 122.

The upper frame 511 and the fixing member 511*a* are engaged so that the head portion 531 of the piston 530 is inserted into the cylinder 110*a*.

The inner and outer side laminations 121*a* and 121*b* of the stator 121 of the driving motor 120 are fixedly engaged to the lower frame 512, and the rotor 122 is inserted between the inner and outer side laminations 121*a* and 121*b*, and the upper frame 511 and the lower frame 512 are engaged.

Next, the lower surfaces of the upper frame 111 and the sealing shell 114 are sealingly engaged in such a manner that the lower frame 512 is surrounded for thereby preventing a leakage of the working gas.

The operation of the compressor integrated pulse tube refrigerator of an oil free type according to the fifth embodiment of the present invention will be explained.

In the fifth embodiment of the present invention, a small phase difference occurs at the vibration cycle between the rotor 122 and the piston 530, so that the driving motor 120 receives a load. In the present invention, the spacer 550 is closely disposed between the support members 541 and 542, it is possible to decrease the load due to the phase difference of the vibration cycle, so that the driving motor 120 receives less loads.

In the fifth embodiment of the present invention, the elastic guide support members 541 and 542 are engaged at the upper frame 111. Therefore, one frame is removed compared to the first embodiment of the present invention. In addition, since the elastic guide support members 541 and 542 are installed above the driving motor 120, the number of the elements which need a high accuracy process is decreased. The driving shaft is not additionally needed, and the rotor 122 and the piston 530 are directly connected. It is easy to concentrically arrange the driving motor 120 and the lower frame 512 in which the driving motor 120 is installed. Preferably, the driving motor 120 and the piston 530 may be separately assembled.

Since the piston 530 is directly engaged to the rotor 122, it is possible to minimize the load applied to the driving motor 120, and a compact size refrigerator may be implemented.

As described above, in the compressor integrated pulse tube refrigerator of an oil free type according to the fifth embodiment of the present invention, the elastic guide support members which enable a continuous reciprocating movement of the piston is disposed between the piston and the rotor, so that it is possible to decrease the number of the elements which need a high accuracy process. In addition, the driving shaft for transferring the driving force of the driving motor is removed, so that the driving motor and the piston is separately assembled. Therefore, it is possible to implement a concentric assembly and productivity. The processing accuracy of each frame is increased, and the load applied to the driving motor is decreased. A compact size refrigerator may be implemented.

The compressor integrated pulse tube refrigerator of an oil free type according to a sixth embodiment of the present invention will be explained with reference to the accompanying drawings.

As shown in FIGS. 22 through 25, the driving unit of the compressor integrated pulse tube refrigerator of an oil free type according to the sixth embodiment of the present invention includes a sealed casing 610, a driving motor 120, a driving shaft 630, a piston 140, an elastic support member 151, and a linear bearing 660 which is disposed in the stator 121 of the driving motor 120 and operates as a guide support member.

In the sealed casing 610, the cylinder 110*a* into which the piston 140 is inserted and reciprocates therein is provided in the upper frame 111. The elastic support member 151 for guiding a continuous reciprocating movement of the piston 140 is engaged to the lower frame 112 engaged to the upper frame 111. The sealing shell 114 is sealingly engaged to the lower surface of the upper frame 111 for surrounding the lower frame 112 for thereby preventing a leakage of the working gas from the sealed casing 610.

A circular shape motor support portion 112*a* is formed on an inner circumferential surface of the lower frame 112 for engaging the stator 121 of the driving motor 120, and a plurality of protrusion shape support member engaging portion 112*b* are formed for engaging the elastic support member 151.

Here, the structure of the driving motor 120 is the same as the first embodiment of the present invention. The outer side lamination 121*b* is engaged to the lower frame 112 of the sealed casing 610. The inner lamination 121*a* is integrally engaged with the outer side lamination 121*b* by the connection ring 123.

The driving shaft 630 is integral with the rotor 122 of the driving motor 120 and passes through the center portion of the stator 121. The upper portion of the driving shaft 630 is integrally engaged to the elastic support member 151, and the outer surface of the lower portion of the driving shaft 630 is slidably contacts with the linear bearing 660 which is the guide support member inserted into the inner side lamination 121*a* and is supported in the radial direction.

Figure 24:
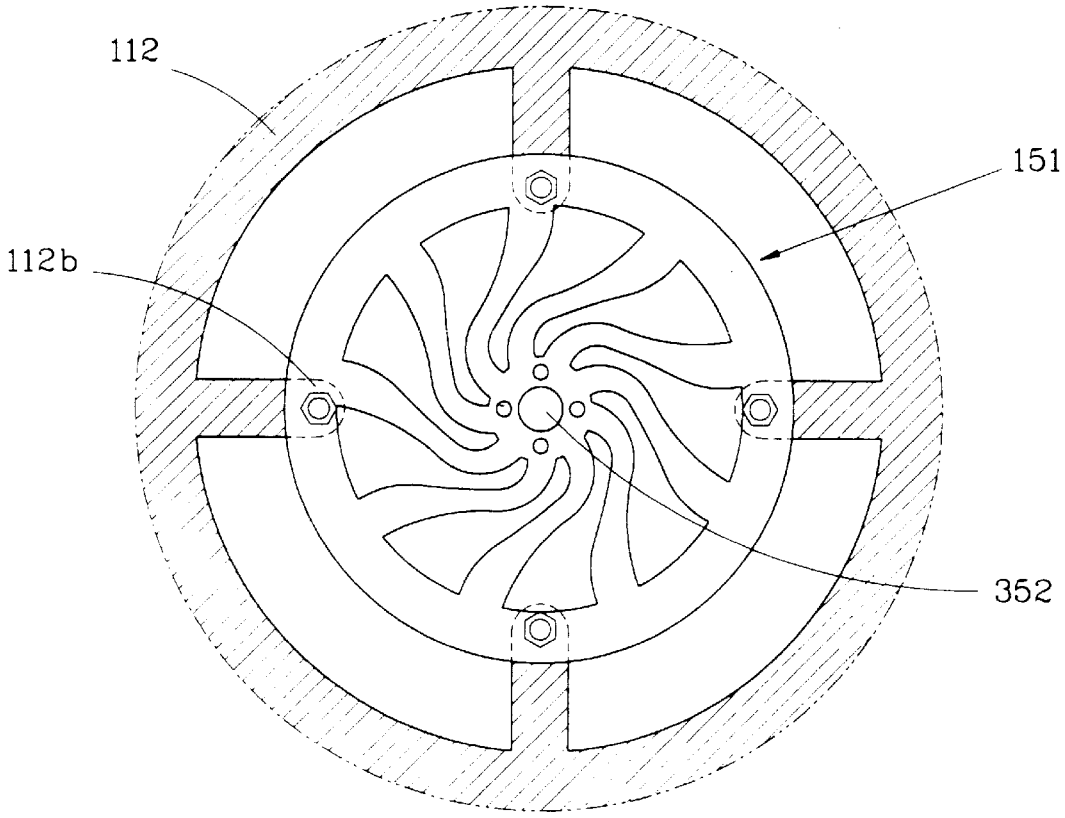
FIG. 24 is a cross-sectional view taken along line XXIV—XXIV of FIG. 23.
Figure 25:
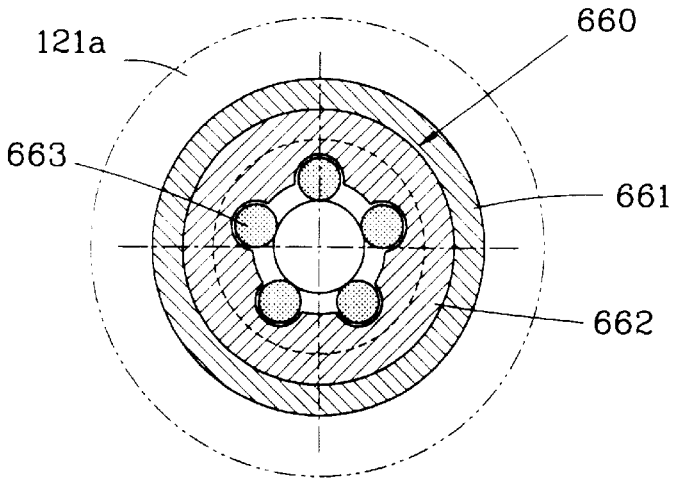
FIG. 25 is a horizontal cross-sectional view illustrating the portion XXV of FIG. 23.

The elastic support member 151 is a known spiral shape circular plate spring. As shown in FIG. 24, the driving shaft engaging hole 352 formed at the center portion is formed concentrically with respect to the cylinder 110*a* of the upper frame 111 for implementing a linear movement of the piston 140.

The linear bearing 660 is used for radially supporting the piston 140. The outer surface of the linear bearing 660 is inserted into the center portion of the stator 121, and the inner surface of the same slidably contacts with the outer surface of the driving shaft 630 and is concentrical with respect to the driving shaft engaging hole 352 of the elastic support member 151 and the cylinder 110*a*.

In the drawings, reference numeral 661 represents an insertion bush, 662 represents a retainer, and 663 represents a ball bearing.

The compressor integrated pulse tube refrigerator of an oil free type according to the sixth embodiment of the present invention is assembled by the following methods.

First, the outer side lamination 121*b* of the driving motor 120 is engaged to the motor support portion 112*a* of the lower frame 112, and the inner side lamination 121*a* is inserted into the center portion of the outer side lamination 121*b* at a certain interval and is fixed by the connection ring 123. The driving shaft 630 is engaged to the rotator 122, and the driving shaft 630 is inserted into the center portion of the inner side lamination 121*a* so that the rotator 122 is disposed in the space formed between the inner and outer side laminations 121*a* and 121*b*.

At this time, the lower portion of the driving shaft 630 is inserted into the linear bearing 660 inserted into the lower center portion of the inner side lamination 121*a*.

Next, the upper portion of the driving shaft 630 is inserted into the driving shaft engaging hole 352 as shown in FIG. 24 and is engaged to the elastic support member 151, and the edge portion of the elastic support member 1541 is engaged to the lower frame 112. The piston 140 is integrally engaged to the upper portion of the driving shaft 630, and the upper frame 111 is engaged to the lower frame 112 so that the piston 140 is inserted into the cylinder 110*a*.

The upper portion of the sealing shell 114 is sealingly engaged to the lower surface of the upper frame 111 for thereby preventing a leakage of the working gas.

The operation of the driving apparatus for a compressor integrated pulse tube refrigerator of an oil free type according to the sixth embodiment of the present invention will be explained.

In the sixth embodiment of the present invention, the elastic support member 151 engaged to the upper portion of the driving shaft 630 stores the linearly reciprocating movement of the rotor 122 as an elastic energy by receiving the reciprocating movement of the driving shaft 630. The thusly stored elastic energy is changed to the linear movement, so that the rotor 122 is resonantly moved, and the piston 140 continuously reciprocates.

The linear bearing 660 which is the guide support member into which the lower portion of the driving shaft 630 is inserted radially supports the piston 140 so that the piston 140 is moved by receiving the linear movement of the rotator 122 reciprocates at a certain gap between the piston 140 and the cylinder 110*a*.

The elastic support member 151 is formed of the plate spring 150 in which the driving shaft engaging hole 352 is formed concentrically with respect to the cylinder 110*a*, so that the piston 140 continuously reciprocates. The guide support member 660 is used for radially supporting the piston 140 by inserting the linear bearing 660 onto the driving shaft 630, so that it is possible to easily implement a concentric arrangement when fabricating and assembling the corresponding elements.

As another example of the sixth embodiment of the present invention, when the guide support member is inserted into the upper portion of the inner side lamination 121*a*, the length of the driving shaft 630 may be decreased, so that the load applied to the driving motor 120 is minimized, and a small sized refrigerator is implemented.

As described above, in the compressor integrated pulse tube refrigerator of an oil free type according to the sixth embodiment of the present invention, since there are provided an elastic support member which enables a continuous linear movement of the piston and a linear bearing which is the guide support member inserted into the center portion of the stator of the driving motor, it is possible to easily implement the concentric arrangement of the support members. The number of the elements is decreased. The length of the driving shaft may be decreased. The load applied to the driving motor is decreased, and a small sized refrigerator may be fabricated.

The compressor integrated pulse tube refrigerator for an oil free type according to the seventh embodiment of the present invention will be explained with reference to the accompanying drawings.

Figure 26:
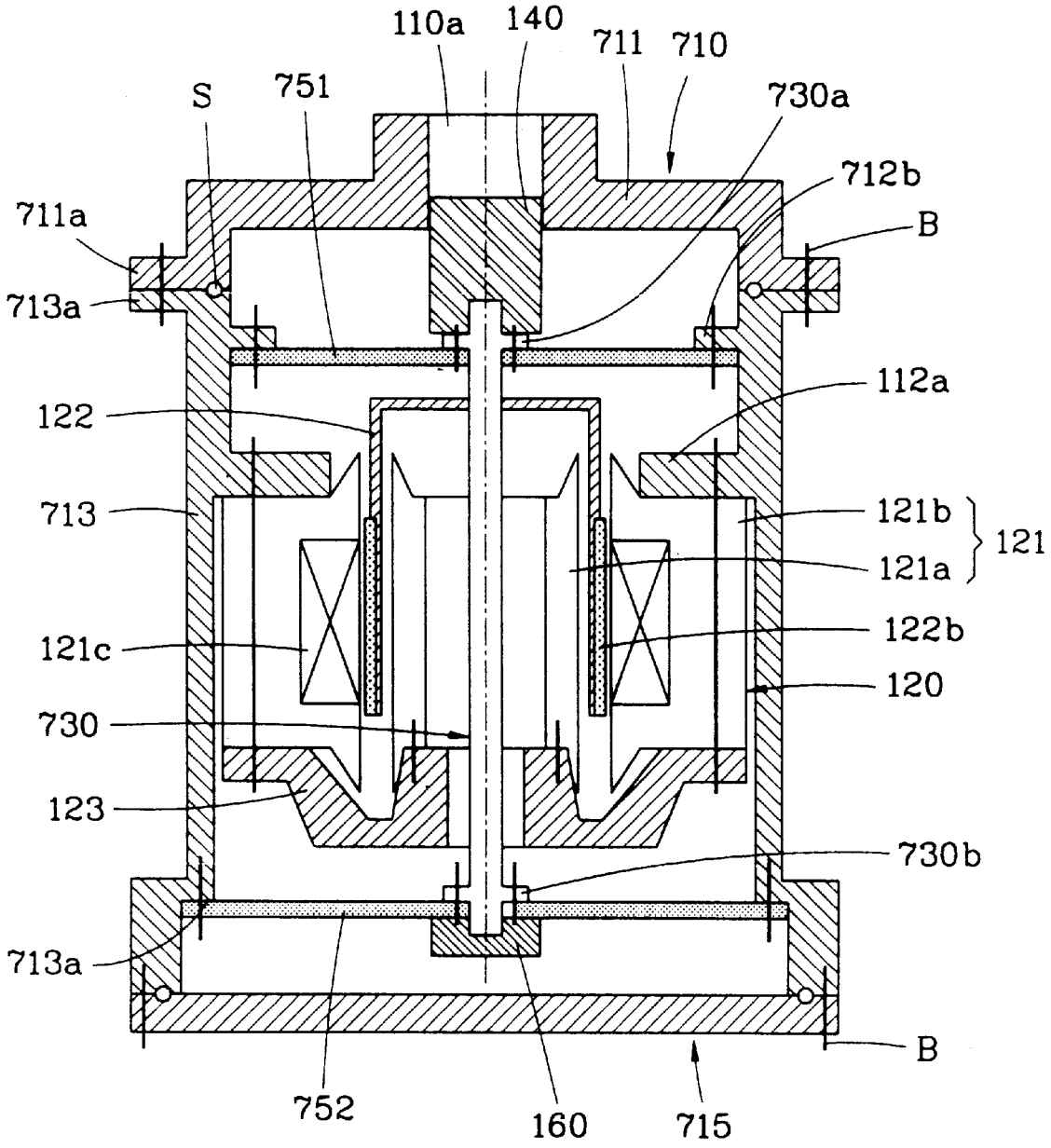
FIG. 26 is a cross-sectional view illustrating a compressor integrated pulse tube refrigerator of an oil free type according to a seventh embodiment of the present invention.
Figure 27:
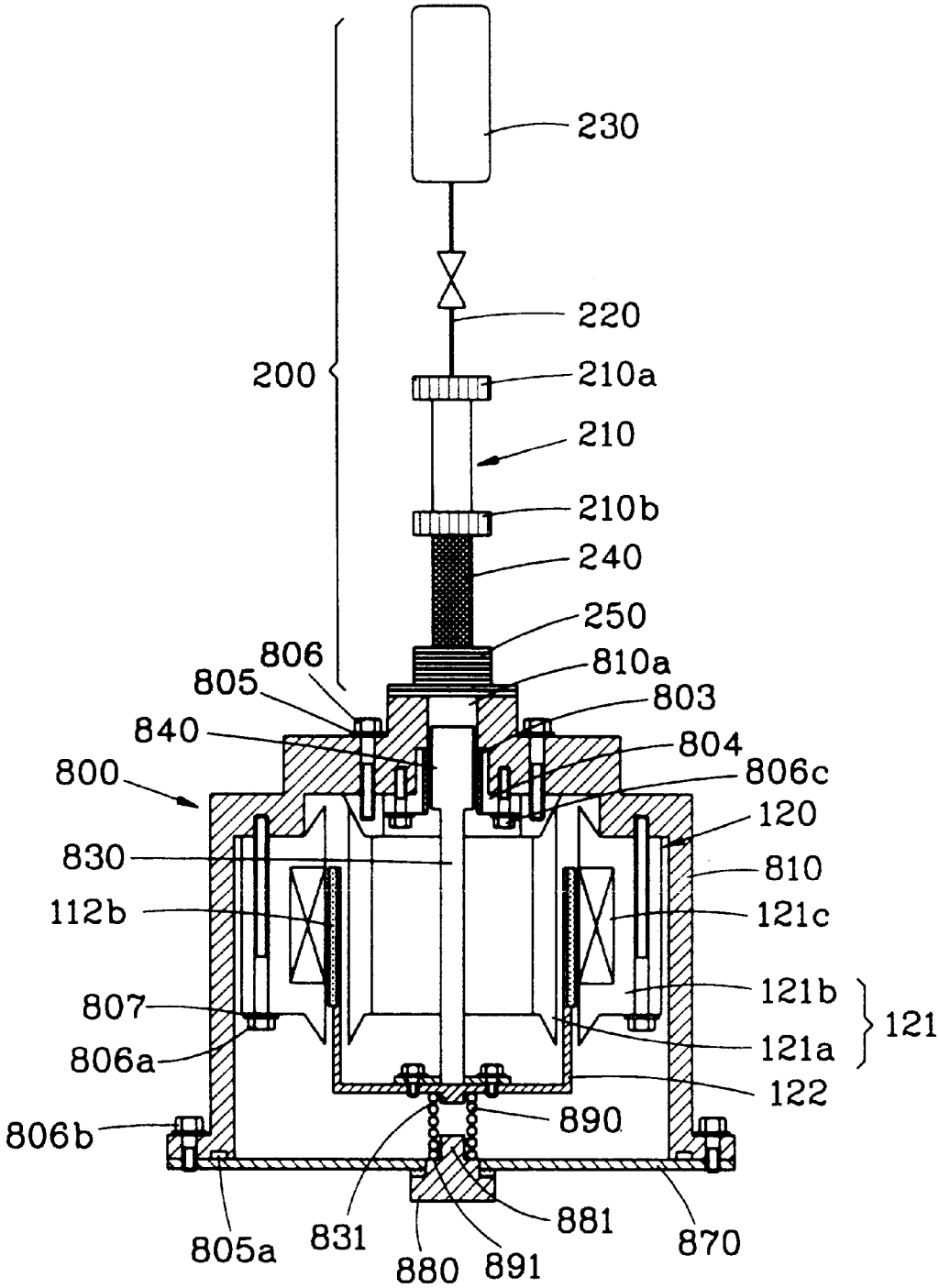
FIG. 27 is a vertical cross-sectional view illustrating a compressor integrated pulse tube refrigerator of an oil free type according to an eighth embodiment of the present invention.
Figure 28:
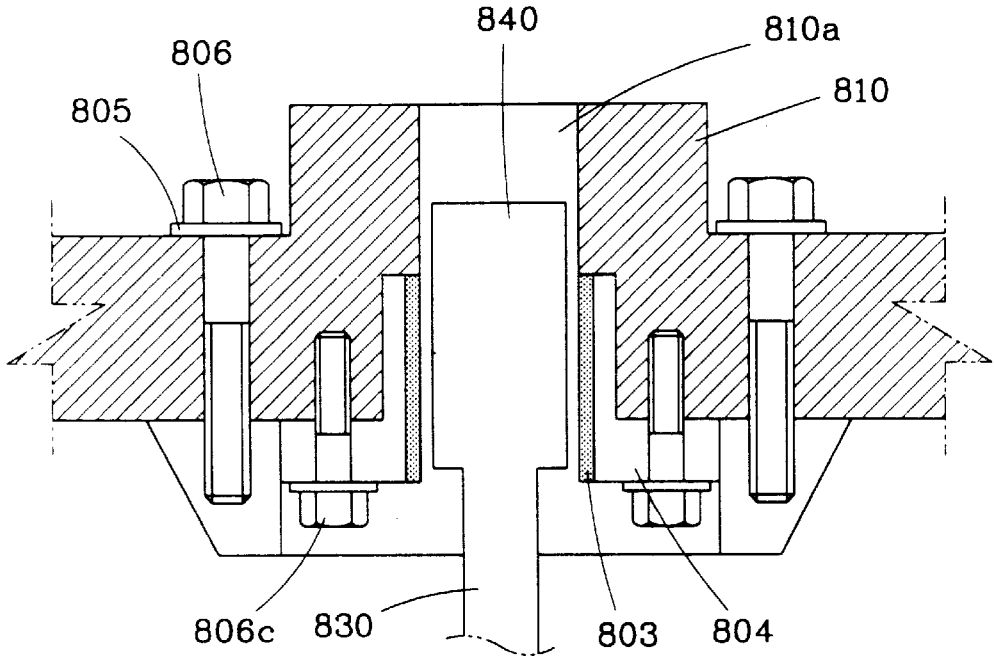
FIG. 28 is an enlarged view illustrating a state that a piston is inserted into a cylinder of FIG. 27.
Figure 29:
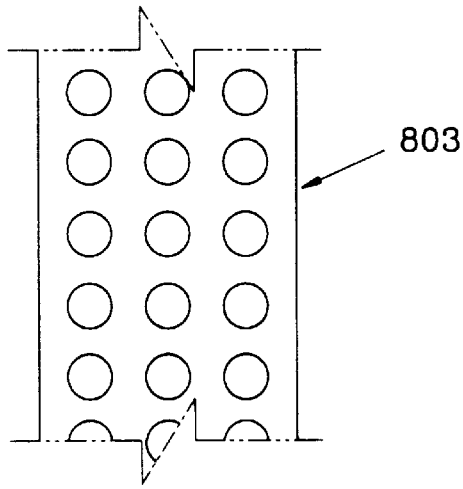
FIG. 29 is a front view illustrating an inner surface of a linear bearing of FIG. 27.

As shown in FIG. 26, the driving unit of the compressor integrated pulse tube refrigerator of an oil free type according to the seventh embodiment of the present invention includes a sealed casing 710, a driving motor 120, a driving shaft 730, a piston 140, a first elastic guide support member 751, and a second elastic guide support member 752.

The features of the seventh embodiment of the present invention will be explained by focusing on the structure of the sealed casing 710, the structures and installation positions of the first and second elastic guide support members 751 and 752, and the structures of the spring engaging portion 712*b* and 713*a*.

In the sealed casing 710 according to the seventh embodiment of the present invention, there is provided an upper frame 711 in which the cylinder 110 is provided in a protruded shape. The piston 140 is inserted into the cylinder 110*a* and reciprocates therein. In addition, there is provided a lower frame 713 engaged to the lower surface of the upper frame. The driving motor 120 is engaged in the interior of the lower frame 713. The edge portion of the first elastic guide support member 751 which is engaged to the upper portion of the driving shaft 730 and enables a linear reciprocating movement of the piston is engaged to the lower frame 713. A plurality of sealing shells 715 are provided below the lower frame 713 for preventing a leakage of the working gas from the sealed casing 710.

The sealing shell 715 is formed to have a uniform thickness and a certain area. The support members 751 and 752 are formed of the plate spring.

The construction according to the seventh embodiment of the present invention will be explained. The upper portion of the driving shaft 730 is inserted into the lower center portion of the piston 140.

The first elastic guide support member engaging portion 712*b* is protruded from the inner surface of the lower frame 713 in the radial direction at the inner upper portion of the lower frame 713, concentrically with respect to the cylinder 110*a*, for engaging the first elastic guide support member 751. The lower portion of the lower frame 713 is radially extended in the downward direction, and the extended portion is the first elastic guide support member engaging portion 713*a* for engaging the first elastic guide support member 751.

The outer diameter of the second elastic guide support member 752 is greater than the outer diameter of the first elastic guide support member 751.

The driving shaft 730 is integral with the rotor 122 of the driving motor 120 and passes through the stator 121. The upper portion of the driving shaft 730 is integrally inserted into the piston 140, and the lower portion of the driving shaft 730 passes trough the center portion of the second elastic guide support member 752 and is engaged to the engaging member 160.

An upper support member 730*a* which contacts with an upper center portion of the first elastic guide support member 751 is formed at an upper outer portion of the driving shaft 730 at the lower portion of the piston 140. In addition, a lower support shoulder portion 730*b* which contacts with the upper center portion of the second elastic guide support member 752 is formed at an outer portion of the driving shaft 730 disposed at the upper portion of the fixing member 160 below the driving shaft 730.

The sealing shell 715 and the lower frame 713, and the upper frame 711 and the lower frame 713 are engaged by the engaging members B, and the sealing members S are provided therebetween, respectively.

In the seventh embodiment of the present invention, the inner diameter of the body portion of the lower frame 713 into which the linear motor 120 is inserted is the same as the inner diameter of the upper frame 711, and the inner diameter of the first elastic guide support member engaging portion 713*a* formed for engaging the second elastic guide support member is greater than the inner diameter of the body portion, so that the heat is effectively radiated from the linear motor 120, and the first elastic guide support member 751 and the second elastic guide support member 752 which support the driving shaft 730 are engaged to the lower frame 713.

At this time, since the outer diameters of the first elastic guide support member 751 and the second elastic guide support member 752 are different, the entire elastic constants of the first elastic guide support member 751 and the second elastic guide support member 752 are controlled to be a resonance frequency.

As described above, in the compressor integrated pulse tube refrigerator according to a seventh embodiment of the present invention, first and second elastic guide support members 751 and 752 are engaged at the body frame for supporting the driving shaft which transfers the driving force of the linear motor to the piston inserted into the cylinder. Therefore, it is easy to adjust a concentricity of the engaging portions for engaging the first elastic guide support member 751 and the second elastic guide support member 752. In addition, an assembling error of the first elastic guide support member 751 and the second elastic guide support member 752 is decreased, so that it is possible to implement a concentricity of the piston connected with the driving shaft and an accurate linear movement of the piston. The numbers of the parts and the fabrication processes are decreased, so that the fabrication cost is decreased, and the productivity of the assembling processes is enhanced, In the seventh embodiment of the present invention, since the number of the parts is decreased, the processes for fabricating the parts are decreased, and the number of the part assembling processes is decreased.

The compressor integrated pulse tube refrigerator for an oil free type according to an eighth embodiment of the present invention will be explained with reference to the accompanying drawings.

The inner side lamination 121*a* of the stator is engaged at the inner center portion of the sealed casing 810 by the engaging member 806 in which the sealing material 805 is provided. On the outer surface of the inner side lamination 121*a* of the sealed casing 810, the outer side lamination 121*a* formed in the sealed casing 810 is provided in the interior of the sealed casing 810 by the engaging member 806*a* having a hollow disk type connection member 807 (washer, etc.) inserted thereto.

The driving shaft 830 which is disposed between the inner and outer side laminations 121*a* and 121*b* and is engaged with the rotator 122 engaged with the magnet 122*b* to be opposite to the coil 121*c* passes through the inner side lamination 121*a* in the sealed casing 810, and at the upper portion of the driving shaft 830, the piston 840 which is inserted into the cylinder 810*a* of the sealed casing 810 and reciprocates with the driving shaft 830 for thereby pumping the working gas is integrally installed with respect to the driving shaft 830.

In addition, the sealing cover 870 is engaged at the lower portion of the sealed casing 810 by the engaging member 806*b* for preventing a leakage of the working gas. A sealing material 805*a* is inserted between the lower portion of the sealed casing 810 and the sealing cover 870 for implementing a sealed state therebetween. The adjusting member 880 is engaged at the center portion of the sealing cover 870. The elastic coil spring 890 is supportedly disposed between the support plate 831 formed at the lower portion of the driving shaft 830 and the support plate 881 formed at the upper portion of the adjusting member 880. A tension adjusting ring 891 is inserted between the sealing cover 870 and the adjusting member 880 for adjusting an initial compression state of the coil spring 890.

When assembling the driving unit 800 according to the eighth embodiment of the present invention, a sleeve 804 in which the linear bearing 803 is inserted for implementing a linear reciprocating movement of the piston 840 is inserted into the lower inner surface of the cylinder 810*a*.

The inner side lamination 121*a* of the stator 121 of the driving motor 120 is provided at the inner center portion of the sealed casing 810, and the engaging member 806 into which the sealing material 805 is inserted from the upper portion of the sealed casing 810 is engaged with the inner side lamination 121*a*, and the inner side lamination 121*a* is engaged in the interior of the sealed casing 810. The outer side lamination 121*b* in which a plurality of coils 121*c* are engaged on the outer surface of the inner side lamination 121*a* in the interior of the sealed casing 810 is engaged in the interior of the sealed casing 810 by the engaging member 806*a* into which the hollow disk type connection member 807 is inserted. The piston 840 integrally formed at the upper portion of the driving shaft 830 is inserted into the cylinder 810*a* of the sealed casing 810. When engaging the rotor 122 to the driving shaft 830, the rotor 122 is disposed between the inner and outer side laminations 121*a* and 121*b*.

In a state that the adjusting member 880 is roughly engaged by inserting the tension adjusting ring 891 into the center portion of the sealing cover 870 from the lower portion to the upper portion, the coil spring 890 is inserted between the support plate 881 formed at the upper portion of the adjusting member 880 and the support plate 831 formed at the lower portion of the driving shaft 830 for thereby engaging the adjusting member 880.

At this time, since the tension adjusting ring 891 is inserted between the center portion of the sealing cover 870 and the adjusting member 880 inserted into the center portion, it is possible to implement a sealed state. In addition, it is possible to effectively adjust the elastic force (repulsion force) of the coil spring 890 based on the linear reciprocating movement of the piston 840 by adjusting the initial compression force of the coil spring 890 and the thickness of the tension adjusting ring 891.

Figure 30:
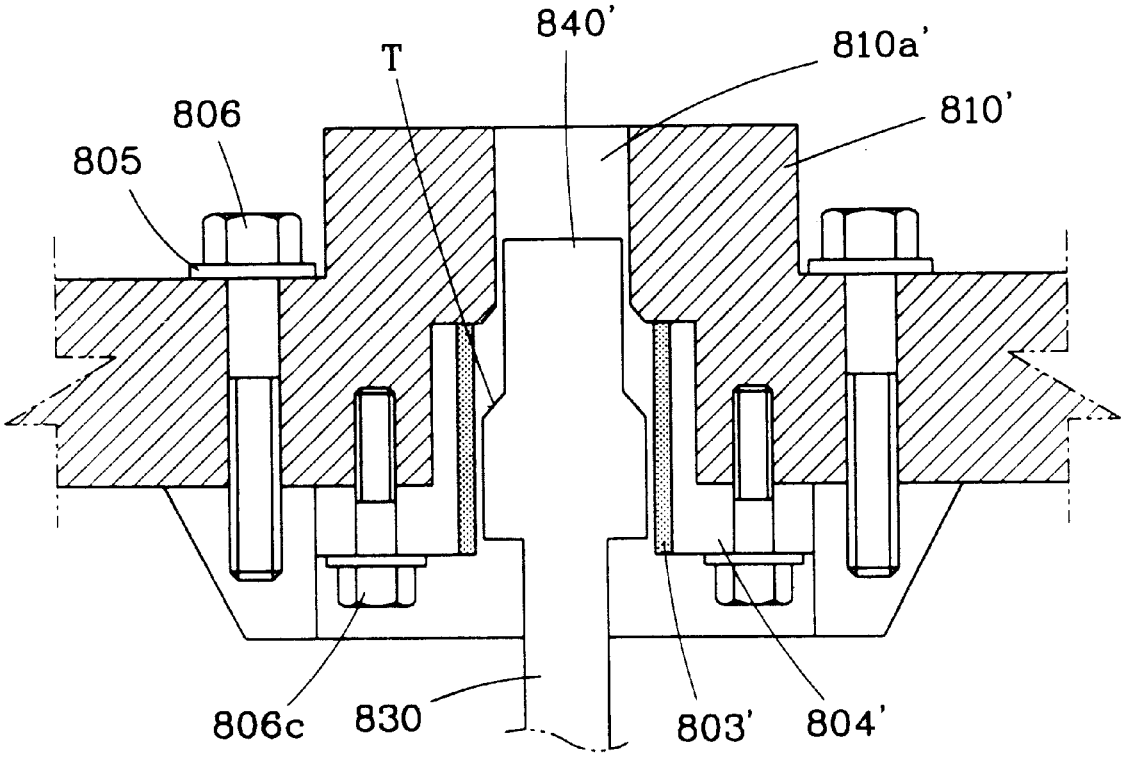
FIG. 30 is a vertical cross-sectional view illustrating an example of a compressor integrated pulse tube refrigerator of an oil free type according to an eighth embodiment of the present invention.

As shown in FIG. 30, in another example of the eighth embodiment of the present invention, the diameter of the lower portion of the cylinder 810*a*' formed at the upper center portion of the sealed casing 810' may be wider than the diameter of the upper portion of the same.

As shown in FIG. 30, the sleeve 804' having a linear bearing 803' for supporting a linear reciprocating movement of the piston 840*a*' is inserted into the lower portion of the cylinder 810*a*' in such a manner that the inner diameter of the linear bearing 803 is greater than the inner diameter of the cylinder 810*a*', and is engaged by the engaging member 806*c* in the interior of the sealed casing 810'. The outer surface of the piston 840*a*' which is opposite to the linear bearing 803' and the sleeve 804' is expanded to correspond with the inner diameter of the linear bearing 803', so that a certain gap is obtained between the inner surface of the cylinder and the outer surface of the piston.

Since the operation of the compressor integrated pulse tube refrigerator of an oil free type according to the eighth embodiment of the present invention is the same as the operation of the first embodiment of the present invention, the description thereof will be omitted.

As described above, in the eighth embodiment of the present invention, the frame of the driving unit which is adapted to the compressor integrated pulse tube refrigerator of an oil free type and generates a driving force is integral, and the driving shaft and the piston are integral, so that the structure of the driving unit is simplified, and the system is compact. In addition, since a certain part such as a connection ring, etc. is not used, the fabrication cost is decreased. The assembly of the parts becomes easier compared to the conventional art, so that the productivity is significantly increased.

A preferred structure for engaging the plate spring which is used in the first through seventh embodiments of the present invention will be explained with reference to the accompanying drawing.

Figure 31A:
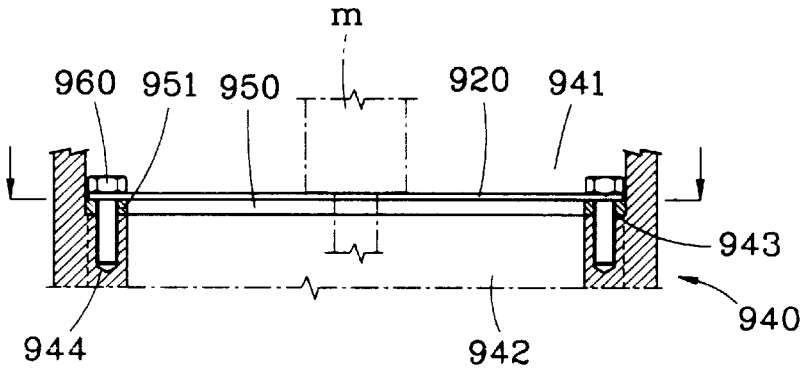
FIG. 31A is a front cross-sectional view illustrating a plate spring mounting structure used for a compressor integrated pulse tube refrigerator of an oil free type according to the present invention.

As shown in FIG. 31*a*, the plate spring engaging structure includes a sealed casing 940 having a recess 943 horizontally formed on an outer surface of the through holes 941 and 942 based on the different diameters of the through holes 941 and 942 and a plurality of female screw holes 944 formed at the recess 943, a support member 950 having its inner portion contacting with the recess 943 and a screw hole 951 corresponding to the female screw hole 944 of the sealed casing 940, a plate spring 920 in which a screw hole(not shown) corresponding to the female screw hole 944 of the sealed casing 940, for thereby being disposed on the upper surface of the support member 950, and a plurality of engaging members 960.

Figure 31B:
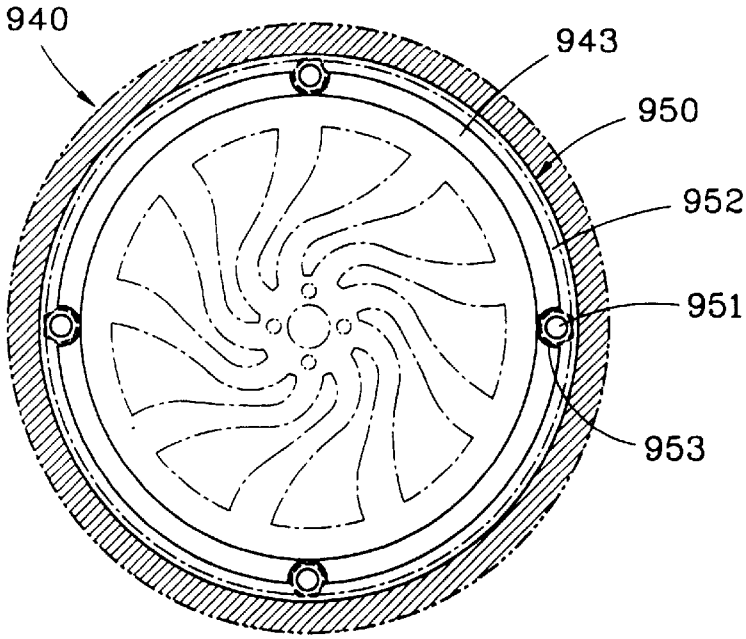
FIG. 31B is a plan cross-sectional view of FIG. 31A.

The female screw hole 944 formed at the recess 943 is formed at a certain interval, and as shown in FIG. 31*b*, the number of the female screw holes 944 is preferably 4.

Figure 32A:
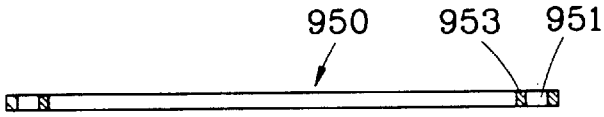
FIG. 32A is a front cross-sectional view illustrating a support member of a plate spring mounting structure used for a compressor integrated pulse tube refrigerator of an oil free type according to the present invention.
Figure 32B:
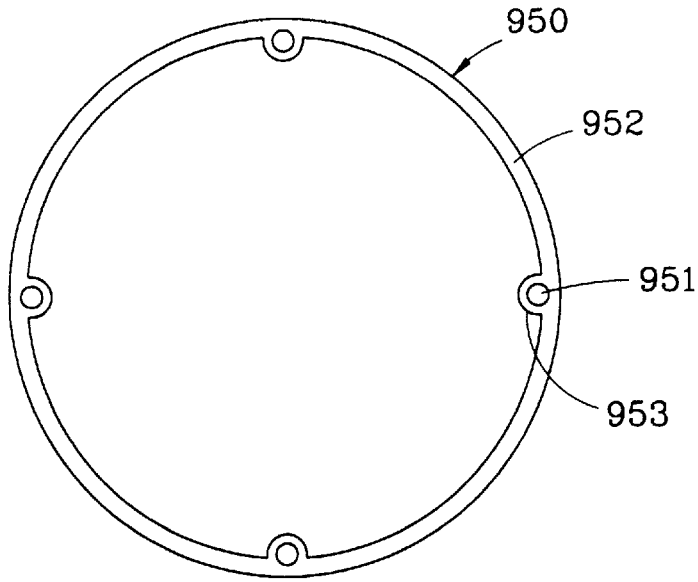
FIG. 32B is a plan view illustrating a support member of a plate spring mounting structure used for a compressor integrated pulse tube refrigerator of an oil free type according to the present invention.

As shown in FIGS. 32*a* and 32*b*, in the support member 950, a plurality of protrusions 953 are formed in a semi-circular shape on an inner surface of the ring portion 952 having a certain thickness and width at a certain interval, and the screw hole 951 passes through the protrusions 953.

The number of the protrusions 953 corresponds with the number of the female screw holes 944 of the sealed casing 940.

The thickness of the support member 950 is determined so that the plate spring 920 does not contact with the sealed casing 940 when the plate spring 920 vibrates.

The maximum width of the protrusion 953 of the support member 950 is the same as or smaller than the width of the recess 943.

The engaging member 960 is preferably engaged using an engaging screw.

When assembling the parts, the screw hole 951 of the support member 950 and the female screw hole 944 are disposed on the recess 943 of the sealed casing 940, and the plate spring 920 is disposed on the support member 950 s that the screw hole of the plate spring 920 is arranged with the screw hole 951 of the support member 950.

The engaging screw, which is the engaging member 960, is inserted into the female screw hole 944 of the sealed casing 940, the screw hole 951 of the support member 950, and the screw hole of the plate spring 920, and the support member 950 and the plate spring 920 are fixed to the sealed casing 940.

As shown in FIGS. 33*a* and 33C, as another embodiment of the support member 950, the support member 950 has a certain thickness and area and includes a plurality of rings 950' each having a through screw hole 951', and the number of the rings 950' corresponds to the number of the female screw holes 944 of the sealed casing 940.

At this time, the outer diameter of the ring 950' is the same as or smaller than the recess 943 formed in the sealed casing 940.

There are provided a plurality of the rings 950' on the recess 943 to correspond with the female screw holes 944 of the recess 943 of the sealed casing 940, and the plate spring 920 is provided thereon and is engaged by the engaging member 960 which is the engaging screw.

The operation and effects of the plate spring engaging structure according to the present invention will be explained.

In the plate spring engaging structure according to the present invention, a shaft or a certain mass is engaged at the center portion of the plate spring 920 in the sealed casing 940, so that an elastic energy stored by absorbing or releasing an impact applied to the shaft or the mass has a certain inherent vibration and is transferred to the outside.

In the present invention, since the support member 950 is engaged between the sealed casing 940 and the plate spring 920, so that it is easy to engage the plate spring 920, and the contact area between the plate spring 920 and the sealed casing 940 is decreased.

Namely, in the present invention, when fabricating the sealed casing 940, the through holes 941 and 942 having different diameters are formed in the interior of the sealed casing 940, and then the female screw hole 944 is formed. Thereafter, the support member 950 may be fabricated based on a press fabrication method by the mass production system.

In addition, in the present invention, the female screw hole 944 in which the engaging member 960(engaging screw) is engaged at the recess 943 in the sealed casing 940, and the support member 950 is engaged at the portion contacting with the plate spring 920, so that it is possible to minimize the contact area of the sealed casing 940 and the plate spring 920.

As described above, in the plate spring engaging structure according to the present invention, the contact area of the sealed casing and the plate spring is minimized, so that a maximum displacement of the plate spring is obtained, and the friction loss is decreased, and the inherent characteristic of the plate spring is maximized. In addition, the fabrication of the parts for engaging the plate spring is more easily implemented for thereby decreasing the fabrication cost.

In addition, it is easy to implement a concentricity and linearity of two plate springs, and an additional frame fabrication is not needed in the present invention, so that the fabrication cost and time are significantly decreased.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. An oil-free compressor-integrated pulse tube refrigerator comprising:

a driving unit including:

a sealed casing having a cylinder disposed at an upper center portion of the sealed casing and a working gas filled therein;

a linear motor installed in the interior of the sealed casing for generating a driving force;

a driving shaft which is engaged to a rotor of the linear motor and which linearly reciprocates;

a piston connected with the driving shaft and inserted in the cylinder and reciprocating together with the driving shaft for thereby pumping a working gas; and a plurality of elastic guide support members provided in the interior of the sealed casing; and a refrigerating unit operatively connected with the cylinder of the driving unit.

2. The refrigerator of claim 1, wherein said refrigerating unit includes:

a pulse tube, in which a compression and expansion cycle is performed at both ends of the pulse tube as a working gas is mass-flown by the working gas pumped by the cylinder of the sealed casing, for generating a heat at its warm end at which the compression operation is performed and absorbing an external heat at its cold end at which the expansion operation is performed;

a phase difference generation apparatus connected with the pulse tube for generating a phase difference based on a mass flow and pressure pulse of the working gas and implementing a thermal balance state;

a storing container connected with the phase difference generation apparatus for temporarily storing the working gas; and a reproducing unit connected between the expansion unit of the pulse tube and the cylinder for storing a sensible heat of the working gas pumped to the pulse tube and supplying the stored heat when the working gas flows from the pulse tube to the cylinder.

3. The refrigerator of claim 1, wherein the plurality of elastic guide support members are formed of two plate springs which generate a resonant movement of the piston and guide a linear movement of the piston.

4. The refrigerator of claim 1, wherein said sealed casing includes:

an upper frame having said cylinder installed therein, said piston being inserted into the cylinder;

an intermediate frame engaged to the lower portion of the upper frame and having its inner surface engaged with an edge portion of a first elastic guide support member engaged with an upper portion of the driving shaft, the linear motor being fixed to the intermediate frame;

a lower frame engaged to the lower portion of the intermediate frame and having its inner surface engaged with an edge portion of a second elastic guide support member engaged to a lower portion of the driving shaft; and a sealing shell which defines a lower portion of the driving unit and prevents a leakage of the working gas from the sealed casing.

5. The refrigerator of claim 4, wherein said upper frame, intermediate frame, lower frame and first and second elastic guide support members are engaged concentrically with respect to the cylinder.

6. The refrigerator of claim 4, wherein said first elastic guide support member is arranged in such a manner that its center portion is passed through by an upper portion of the driving shaft, and its outer surface contacts with an inner surface of the intermediate frame, and said second elastic guide support member is arranged in such a manner that its center portion is passed through by a lower portion of the driving shaft, and its outer surface contacts with an inner surface of the lower frame.

7. The refrigerator of claim 6, wherein a circular motor support portion is formed on an inner surface of the intermediate frame for engaging a stator of the linear motor, a plurality of first protrusion support member engaging portions are formed on a circumferential inner surface of the intermediate frame at the same height as one another for engaging the first elastic guide support member, said first elastic guide support member is engaged at an upper surface of the first protrusion support member engaging portions, a plurality of second protrusion support member engaging portions are formed on a circumferential inner surface of the lower frame at the same height as one another for engaging said second elastic guide support member, and the second elastic guide support member is engaged to the lower surface of the second protrusion support member engaging portions.

8. The refrigerator of claim 7, wherein in said support member engaging portion, a recess formed by a boundary surface of two through holes having different inner diameters is formed, a plurality of female screw holes are formed on the recess, a plurality of screw holes corresponding to the female screw holes are formed in the interior, a support member is displaced at the recess so that the female screw holes are arranged with the screw holes, and the elastic guide support member having a screw hole corresponding to the female screw hole is disposed on the upper surface of the support member and is engaged to the support member engaging portion by a plurality of engaging members.

9. The refrigerator of claim 8, wherein said support member has a certain thickness and width, a plurality of inwardly extended protrusions are formed on an inner surface of the support member, and the screw holes pass through the protrusions.

10. The refrigerator of claim 8, wherein said support member has a certain thickness and area and is formed of a plurality of rings having one through screw hole, and the number of the rings is determined based on the number of the female screw holes of the support member engaging portion.

11. The refrigerator of claim 8, wherein the maximum width of the support member is the same as or smaller than the width of the recess.

12. The refrigerator of claim 4, wherein said first elastic guide support member is arranged in such a manner that its center portion is passed through by an upper portion of the driving shaft and its outer surface contacts with a part of the inner surface of the intermediate frame, and said second elastic guide support member is arranged in such a manner that its center portion is passed through by a lower portion of the driving shaft and its outer surface contacts with a part of the inner surface of the lower frame.

13. The refrigerator of claim 12, wherein said upper frame, intermediate frame, lower frame and first and second elastic guide support members are engaged concentrically with respect to the cylinder.

14. The refrigerator of claim 1, wherein said sealed casing includes:

an upper frame having the cylinder therein which is formed in such a manner that a circular engaging groove expands therefrom, in which an edge portion of a first elastic guide support member engaged with the piston is installed, the piston being inserted in the cylinder;

an intermediate frame tightly engaged with a lower portion of the upper frame for fixedly installing the linear motor therein;

a lower frame engaged to the lower portion of the intermediate frame and supporting a second elastic guide support member engaged to a lower portion of the driving shaft; and a sealing shell which defines a lower portion of the driving unit and prevents a leakage of the working gas from the sealed casing.

15. The refrigerator of claim 14, wherein said engaging groove, upper frame, intermediate frame, lower frame and first and second elastic guide support members are concentrically arranged.

16. The refrigerator of claim 14, wherein said first elastic guide support member is engaged in such a manner that its edge portion is positioned in the engaging groove of the cylinder and is fixed to the upper frame and its center portion passes through a connection rod extended from an end portion of the piston in the upward direction and is fixed thereto.

17. The refrigerator of claim 1, wherein said sealed casing includes:

an upper frame, in which said cylinder is formed and has said piston therein, engaged with an edge portion of a first elastic guide support member;

a lower frame which is engaged to a lower portion of the upper frame and is engaged with said linear motor therein and a lower portion of a second elastic guide support member, respectively; and a sealing shell which defines a lower portion of the driving unit and prevents a leakage of the working gas from the sealed casing.

18. The refrigerator of claim 17, wherein said second elastic guide support member includes its lower portion engaged to a lower surface of the lower frame, and an upper portion of the second elastic guide support member is a compression coil spring inserted onto the driving shaft.

19. The refrigerator of claim 18, wherein a portion of the driving shaft which contacts with an upper surface of the second elastic guide support member is extended in a radial direction.

20. The refrigerator of claim 17, wherein said first elastic guide support member has its center portion which is passed through by an upper portion of the driving shaft, and an edge portion of the first elastic guide support member is formed of a plate spring engaged to a fixing member concentric with respect to the upper frame.

21. The refrigerator of claim 17, wherein said upper frame, lower frame, first elastic guide support member and second elastic guide support member are arranged concentrically with respect to the cylinder.

22. The refrigerator of claim 1, wherein said sealed casing includes:

an upper frame in which said cylinder is installed;

a lower frame engaged to a lower portion of the upper frame and having its inner surface engaged with the linear motor, and a first elastic guide support member engaged with an upper portion of the driving shaft, and an edge portion of a second elastic guide support member engaged to a lower portion of the driving shaft; and a sealing shell sealingly engaged to a lower portion of the upper frame in such a manner that the lower frame is surrounded thereby for preventing a leakage of the working gas from the sealed casing.

23. The refrigerator of claim 20, wherein said first elastic guide support member is a plate spring having its center portion which is passed through by a upper portion of the driving shaft and is engaged to the lower frame, and said second elastic guide support member has its outer surface fixedly inserted into a center portion of the stator of the linear motor, and its inner surface which slidably contacts with an outer surface of the driving shaft.

24. The refrigerator of claim 22, wherein said upper frame, lower frame, first elastic guide support member and second elastic guide support member are arranged concentrically with respect to the cylinder.

25. The refrigerator of claim 1, wherein said sealed casing includes:

an upper frame in which said cylinder having said piston therein is provided;

a lower frame engaged to a lower portion of the upper frame and having said linear motor installed therein and engaged with a first elastic guide support member engaged with an upper portion of the driving shaft, and an edge portion of the second elastic guide support member engaged with a lower portion of the driving shaft; and a sealing shell which covers the lower frame from the lower portion of the lower frame for thereby preventing a leakage of the working gas.

26. The refrigerator of claim 25, wherein said first and second elastic guide support members have their outer surfaces which fully contact with the inner surface of the lower frame, respectively.

27. The refrigerator of claim 25, wherein said upper frame, lower frame and first and second elastic guide support members are arranged concentrically with respect to the cylinder.

28. The refrigerator of claim 25, wherein a radially extended support shoulder portion is formed at a portion of the driving shaft for being contacted with an upper surface of the second elastic guide support member.

29. The refrigerator of claim 25, wherein a lower portion of the lower frame is downwardly bent and expanded in the radius direction, and the thusly expanded portion becomes an elastic support member engaging portion for engaging the second elastic guide support member.

30. The refrigerator of claim 25, wherein an outer diameter of the second elastic guide support member is greater than the outer diameter of the first elastic guide support member.

31. The refrigerator of claim 25, wherein said first and second elastic guide support members are constructed so that the sum of the entire spring constants of the first and second elastic guide support members becomes a resonant frequency.

32. The refrigerator of claim 1, wherein said sealed casing is integral and in said sealed casing, the first elastic guide support member and the second elastic guide support member are engaged, and the cylinder has a lower portion diameter wider than the upper portion diameter of the same.

33. The refrigerator of claim 32, wherein the first elastic guide support member is inserted at a lower portion of the cylinder for obtaining a constant inner diameter of the cylinder and is engaged to a portion in the sealed casing.

34. The refrigerator of claim 33, wherein said first elastic guide support member is a sleeve having a linear bearing therein.

35. The refrigerator of claim 32, wherein said second elastic guide support member is a coil spring disposed between the support plate formed at a lower portion of the driving shaft and the support plate formed at an upper portion of the adjusting member engaged to a center portion of the sealing cover which defines a lower surface of the sealed casing.

36. The refrigerator of claim 35 wherein a tension force adjusting ring is inserted between the sealing cover and the adjusting member for adjusting an initial compression state of the coil spring.

37. The refrigerator of claim 32, wherein a sleeve having a linear bearing therein for supporting a linear reciprocating movement of the piston is provided at a lower portion of the cylinders wherein an inner diameter of the linear bearing is greater than the inner diameter of the cylinder and is engaged to the sealed casing, and a lower outer surface of the piston is expanded more than an upper outer surface to correspond with the inner diameter of the linear bearing.

38. An oil-free compressor- integrated pulse tube refrigerator comprising:

a driving unit including a sealed casing having a cylinder therein at an upper center portion of the sealed casing, wherein a working gas is filled in the sealed casing;

a linear motor installed in the interior of the sealed casing for generating a driving force;

a piston inserted in the cylinder and having a head portion and a shaft portion having a diameter smaller than the head portion and moving together with a rotor of the linear motor engaged with a nut-shaped engaging member in a state that the shaft portion is engaged with the rotor of the linear motor; and a plurality of elastic guide support members engaged in the interior of the sealed casing for generating a resonant movement of the piston; and a refrigerating unit operatively connected with the cylinder of the driving unit.

39. The refrigerator of claim 38, wherein said sealed casing includes:

an upper frame having said cylinder into which said piston is inserted and having its inner portion engaged with the edge portions of the plurality of elastic guide support members;

a lower frame engaged to a lower portion of the upper frame wherein the linear motor is installed therein; and a sealing shell which forms a lower portion of the driving unit for preventing a leakage of the working gas from the sealed casing.

40. The refrigerator of claim 39, wherein a fixing member inwardly bent for engaging the support member and having upper and lower portions from which the support member engaging portion is protruded is engaged at a lower center portion of the upper frame, and the plurality of elastic guide support members having their center portions passing through the shaft portion of the piston are engaged on the upper and lower surfaces of the support member engaging portion in the upward and downward directions.

41. The refrigerator of claim 38, wherein a spacer is interposed between the elastic guide support members in a state that the spacer contacts with an outer surface of the piston.

* * * * *